US007661565B2

(12) United States Patent
Jackman

(10) Patent No.: US 7,661,565 B2
(45) **Date of Patent: *Feb. 16, 2010**

(54) PRESSURE ACTIVATED SELF OPENING CONTAINER AND SEAL

(76) Inventor: Brian F. Jackman, 51 Beale St., Worcester, MA (US) 01606

( * ) Notice: Subject to any disclaimer, the term of this patent is extended or adjusted under 35 U.S.C. 154(b) by 209 days.

This patent is subject to a terminal disclaimer.

(21) Appl. No.: 11/810,599

(22) Filed: Jun. 6, 2007

(65) Prior Publication Data

US 2007/0290012 A1 Dec. 20, 2007

Related U.S. Application Data

(63) Continuation-in-part of application No. 10/761,063, filed on Jan. 20, 2004, now Pat. No. 7,237,698.

(51) Int. Cl.
*B65D 47/10* (2006.01)

(52) U.S. Cl. ..... 222/541.4; 222/541.1; 222/541.3; 222/541.6; 215/232; 215/250; 215/253; 215/270

(58) Field of Classification Search ..... 222/541.4, 222/541.3, 541.1, 541.6, 490–491, 494, 212, 222/107, 213; 215/232, 253, 260, 250, 270–271, 215/350, 354, 344

See application file for complete search history.

(56) References Cited

U.S. PATENT DOCUMENTS

| | | | | |
|---|---|---|---|---|
| 4,696,328 | A | 9/1987 | Rhodes, Jr. | |
| 4,789,082 | A | 12/1988 | Sampson | |
| 4,938,390 | A | 7/1990 | Markva | |
| 4,949,857 | A | 8/1990 | Russell | |
| 5,353,968 | A | 10/1994 | Good, Jr. | |
| 5,634,504 | A | 6/1997 | Chandler | |
| 7,237,698 | B2 * | 7/2007 | Jackman | 222/541.4 |

OTHER PUBLICATIONS

U.S. Appl. No. 10/761,063, filed Jul. 21, 2005, Jackman.

* cited by examiner

*Primary Examiner*—Frederick C. Nicolas

(57) ABSTRACT

A multi layered frangible seal is bonded over the pour spout opening of flexible plastic bottles containing pourable products such as motor oil. The seal provides a leak proof closure that is strong enough to remain intact when the filled uncapped container is held in an inverted position, and at the same weak enough to break open and dispense the contents into a fill opening when a consumer squeezes the inverted container. The seal is constructed from a first layer of leak proof frangible sheet material that is bonded to a second layer of strengthening sheet material. The strengthening layer contains a cut out void configuration that forms a breaking pattern which forces the seal to break open only in the weaker single frangible layered configuration of the cut out void forming the breaking pattern when the container is squeezed.

14 Claims, 14 Drawing Sheets

59A

59B

59C

59D

PRESSURE ACTIVATED SELF OPENING CONTAINER AND SEAL

This application is a Continuation in Part of pending U.S. patent application Ser. No. 10/761,063 filed Jan. 20, 2004 now U.S. Pat. No. 7,237,698.

Elements of the inventive concept disclosed in the specification contained herein also appear in my co-pending U.S. patent application Ser. No. 10/694,137 Filed Oct. 27, 2003 and U.S. patent application Ser. No. 10/939,541 Filed Sep. 13, 2004.

FIELD OF THE INVENTION

The invention resides in the area of pressure activated self opening container seals specifically an improved multi layered sealing closure for sealing over the pour spout opening of flexible containers of the type used for the storage and dispensing of pourable liquids such as motor oil, motor vehicle additives or chemicals and the like. When the container is inverted the seal is of sufficient strength to hold the weight of the liquid contents without breaking. At the same time the seal is also of sufficient weakness to burst open and dispense the contents into a fill opening when a set amount of additional pressure is brought to bear against the seal by a consumer pressurizing the inverted container.

BACKGROUND OF THE INVENTION

It is highly desirable and beneficial to provide flexible containers of the type used for the storage and dispensing of diverse products such as motor oil, transmission fluid, and various other types of motor vehicle additives that have to be poured from the container, with an improved leak proof closure seal that includes a pressure activated self opening feature.

Such container types are comprised of a tubular body portion with a sealed bottom end. An opposite top end is comprised of a funnel shaped neck forming a pour spout that includes means for securing a closure cap. The pour spout ends with an exterior rim that provides a surface area for bonding a seal over the pour spout opening.

This one piece container has gained wide acceptance since introduced and was designed to replace the problematic metal and paperboard can type container being used at the time. Not only did the can type container suffer from a high leakage rate it would also most likely burst when dropped. Additionally, in order to open the container and dispense the contents, a user was required to provide either a can opener and fill funnel or a reusable metal pour spout attachment that was pushed into the can top, piercing the metal, and secured by a press fit. This was an inconvenience and as can be seen the much stronger and durable plastic bottle was a great improvement that has made the can type container obsolete.

When such flexible bottle type container replacements first came into popular use, there were problems associated with the design of the closure caps that caused seepage and leaking of the contents in many containers beyond acceptable limits. To overcome this flaw many manufacturers added a durable foil seal that was bonded over the pour spout opening by induction sealing and was very effective in preventing any leakage prior to the consumer removing the closure cap and seal. Although performing well in this function, these seals proved to be extremely difficult to be removed by hand, requiring the consumer to provide a sharp tool just to open the product.

To correct this fault and to promote product ease of use and consumer convenience manufacturers made advances in closure cap technology and sealing materials for preventing leakage. The induction bonded foil seal was phased out by many manufacturers and replaced with a resilient gasket that is bonded to the underside of the container closure cap and is the primary method currently used by most manufacturers to prevent leakage of the contents.

However, despite the advances made in closure caps to prevent leakage, they have fallen far short of solving the problem. Incorrect torqueing of the screw on closure cap, dropping of the container, jarring through shipping or loading, or poor fit of the gasket, can all cause container leakage prior to the removal of the closure cap. Even with the addition of a locking tear strip at the lower outer perimeter of the closure cap this type of container can still leak and contains no backup provision to prevent it.

In addition to problems with leakage, a second and more serious disadvantage with the flexible plastic container as currently provided, is the extreme difficulty a user experiences when trying to pour the liquid from the container into a narrow fill opening without the contents spilling everywhere.

In order to accomplish this task, a consumer has to judge where to position the container and then begin to slowly invert the container while trying to keep the pour spout exactly in the right place for the liquid to pour into the fill opening. At this point the consumer has to try to bring the pour spout closer to the fill opening so it can be inserted as the container contents continue to pour out. This has to be accomplished as the liquid stream pulses from air being drawn back into the container to equalize the container pressure. An extremely difficult task even in the best of conditions.

When attempting this procedure it becomes obvious that the likely outcome is the container contents end up being spilled into the engine compartment and then drip on to the ground and pollute the environment. A more serious consideration is the possibility of the contents flowing onto hot engine components creating noxious fumes and possible fire.

Although a motorist can avoid this by using a fill funnel, this also has its drawbacks, the funnel becomes covered by the container contents and has to be cleaned after each use or too often a funnel isn't available when needed. Garages with an attendant to provide this service have largely been replaced by self service facilities where there is usually no funnel available. Recognizing this need, some self serve gas stations provide a disposable paper funnel, but then a further problem is, these paper funnels become hazardous waste when soaked with petroleum products, are a waste of natural resources, and are of a considerable cost to the consumer in the form of higher prices.

These disadvantages are well known and could be effectively eliminated by the bonding of a leak proof frangible seal over the pour spout opening that is only of sufficient strength to remain intact when subjected to the pressure created by the weight of the liquid contents when the filled uncapped container is held in an inverted position. At the same time the seal would also have to be sufficiently weak enough to fail and burst open from the additional pressure that can be brought to bear against the seal by a consumer squeezing or striking the filled uncapped container when held in the inverted position. A container seal that incorporated this self opening feature would allow a user to invert the filled uncapped container and then insert the pour spout into the fill opening without spilling the contents. Then by pressurizing the container by compression, the seal would break open and dispense the contents only into the fill opening thereby eliminating the need of an opening device or fill funnel.

There have been numerous patents granted for container closure seals that include this feature. The prior art patents described herein offer similar and differing designs, materials, and fabrication methods in attempting to provide a pressure activated self opening closure seal that functions in this manner.

U.S. Pat. No. 4,696,328 to Rhodes Jr. describes an embodiment of a single layered airtight rupturable plastic container seal that is bonded to the pour spout rim of a flexible oil bottle that stretches, bursts open, and tears apart in an undefined configuration thereby dispensing the contents when the inverted container is squeezed by a consumer.

U.S. Pat. No. 4,789,082 to Sampson describes an embodiment of a single layered seal for an oil bottle consisting of fabric, metal foil, or plastic wherein a first portion of the seal is bonded to the pour spout rim of a flexible container with a releasable adhesive that allows the seal to detach from the rim and dispense the contents when the inverted container is squeezed by a consumer. A second portion of the seal is bonded to the rim with a fixed adhesive which keeps the seal attached to the pour spout after the container is squeezed to open the seal.

U.S. Pat. No. 4,938,390 to Markva describes a number of embodiments of a sealing closure for an oil bottle. A first embodiment describes a single layered seal wherein a first portion of the seal is bonded to the pour spout rim of a flexible container with a releasable adhesive that allows the seal to detach from the rim and dispense the contents when the inverted container is squeezed by a consumer. A second portion of the seal is bonded to the rim with a fixed adhesive which keeps the seal attached to the pour spout after the container is squeezed to open the seal. A second embodiment describes a single layered seal with various tear lines that is bonded to the pour spout rim of a flexible container wherein no portion of the seal releases from the rim, but tears open along the lines and dispenses the contents when the inverted container is squeezed by a user. A third embodiment describes a single layered seal, with a tear line that extends across its diameter, that is bonded to the pour spout rim of a flexible container. Portions of the seal are bonded to the rim with a releasable adhesive that allows the seal to tear open in two halves along the tear line and partially detach from the rim and dispense the contents when the inverted container is squeezed by a user. A portion of each torn half is bonded to the container rim with a fixed adhesive which keeps the detached portions attached to the pour spout. A fourth embodiment describes a seal that consists of a first layer with tear lines that is bonded to the pour spout rim of a flexible container covering over a portion of the pour spout opening wherein no portion of the layer releases from the rim. The remainder of the pour spout opening is covered over by a second layer that partially overlaps, and is bonded to, the first layer and a portion of the rim with a releasable adhesive that allows the second layer to delaminate from the first layer and a portion of the rim to dispense the contents when the inverted container is squeezed by a user. A portion of the second layer is bonded to the container rim with a fixed adhesive which keeps the delaminated layer attached to the pour spout. A fifth embodiment describes a seal that consists of a first layer with an opening and a tear line that is bonded to the pour spout rim of a flexible container wherein no portion of the layer releases from the rim. The opening in the first layer is covered over by a second layer that is bonded to the first layer with a releasable adhesive that allows the second layer to delaminate from the first layer and dispense the contents when the inverted container is squeezed by a user. A portion of the second layer is bonded to the first layer with a fixed adhesive which keeps the delaminated layer attached to the first layer.

U.S. Pat. No. 4,949,857 to Russell describes an embodiment of a single layered rupturable seal of non absorbent material that is bonded over the pour spout mouth of a flexible oil bottle. The seal contains an X shaped breaking pattern consisting of weakened lines that rupture and dispense the contents when the inverted container is squeezed by a consumer.

U.S. Pat. No. 5,353,968 to Good Jr. describes a number of embodiments for a single layered closure for a flexible container consisting of varying materials that has lines or areas of relative weakness on its surface. In a first embodiment the lines or weakened portion consists of an X shaped score that can partially penetrate the closure or be a slit, that blows out and dispenses the contents when the inverted container is squeezed by a consumer. In a second embodiment the lines or weakened portion consists of an X shaped series of perforations penetrating the closure that allow the closure to blow out and dispense the contents when the container is squeezed by a consumer. In a third embodiment the weakened portion consists of a thinned central area formed by compression, boring, or any other suitable means that blows out and dispenses the contents when the inverted container is squeezed by a consumer. If any of the above described embodiments of the closure are used on a container of engine oil, the closure may be made of a plastic that melts when any pieces of the closure break off and contaminate the product going into the engine.

U.S. Pat. No. 5,634,504 to Chandler describes a single layered closure seal consisting of metal foil with a layer of hot melt adhesive used to heat seal the closure to the container rim. The closure seal contains a repeating fracture pattern that allows the seal to burst open and tear along the lines of the fracture pattern when the container is inverted and squeezed by a consumer. The seal contains vent holes to equalize the internal container pressure with the atmospheric pressure.

The prior art patents described herein collectively employ a number of similar and differing seal design and fabrication methods in attempting to construct a container closure that bursts open when subjected to container squeezing pressure. However, each of the embodied design methods employed by the prior art and described herein, manifest similar and differing drawbacks.

A first method makes use of a single layered seal that is bonded over the container opening with a fixed adhesive. The seal bursts open in an undefined configuration when sufficient pressure is applied by squeezing the inverted container such as described in U.S. Pat. No. 4,696,328 to Rhodes Jr. However, this method gives no provision for the possibility that portions of the seal material may tear away and contaminate the contents when opened which could damage the motor by clogging the internal flow of lubrication to critical components.

A second method makes use of a single layered seal that is bonded over the container opening with a fixed adhesive. The seal bursts open in a central thinned area when sufficient pressure is applied by squeezing the inverted container such as described in an embodiment of U.S. Pat. No. 5,353,968 to Good Jr. To overcome the drawback that portions of the seal material may tear away and contaminate the contents when opened, which could damage the motor by clogging the internal flow of lubrication, the seal can be made from a material that melts in the heated oil when the motor reaches its operating temperature. However, with this method there is no provision given for the possible damage that may be caused to the motor by altering the lubricating qualities of the oil by repeatedly contaminating it with melted seal material, or that portions of the seal material may tear away when opened and damage the motor during warm up by clogging the internal flow of lubrication to critical components when a consumer inadvertently adds oil to a cold engine. There is also the inconvenience of having to wait for the motor to warm up before being able to add oil.

A third method makes use of a single layered seal that is bonded over the container opening with a releasable adhesive wherein one or more portions of the seal delaminate from the rim when sufficient pressure is applied by squeezing the inverted container. The seal material is kept from completely detaching from the container by bonding one or more portions of the seal to the pour spout with a fixed adhesive such as described in U.S. Pat. No. 4,789,082 to Sampson and embodiments of U.S. Pat. No. 4,938,390 to Markva. However, with this method there is no provision given for the possibility that using a releasable adhesive with a bond strength that is weak enough to allow the seal to delaminate from the container rim when the inverted container is squeezed, would also allow the seal to delaminate when the closure cap is rotated. The amount of pressure applied against the seal when the closure cap is torqued on or off is many times greater than the small amount of adhesive strength required to allow the seal to delaminate from the pour spout rim when the inverted container is squeezed. Rotation of the closure cap while it is compressed against the seal during installation or removal produces a shearing force that could force the releasable portion of the seal to lose its bond and rotate with the cap which would cause the seal to pleat against the fixed portion resulting in leakage and opening of the seal. Additionally a tack type releasable adhesive with low adhesion characteristics could also be vulnerable to degradation from the volatile organic compounds present in many petroleum based products that could negatively affect the seals ability to remain bonded to the container rim when a given pressure is brought to bear.

A fourth method makes use of a seal that consists of a first layer with an opening that is bonded to the container rim with a fixed adhesive. The opening is covered over by a second layer that is bonded to the first layer with a releasable adhesive that allows the second layer to delaminate from the first layer when sufficient pressure is applied by squeezing the inverted container. The second layer is kept from completely detaching from the container by bonding a portion of the second layer to the first layer with a fixed adhesive such as described in embodiments of U.S. Pat. No. 4,938,390 to Markva. Again, with this method, there is no provision given for the possibility that using a releasable adhesive with a bond strength that is weak enough to allow the second layer to delaminate from the first layer when the inverted container is squeezed, would also allow the second layer to delaminate from the first layer when the closure cap is rotated. The amount of pressure against the seal when the closure cap is torqued on or off is many times greater than the small amount of pressure required to allow the second layer to delaminate from the first layer when the inverted container is squeezed. Rotation of the closure cap while it is compressed against the seal during installation or removal produces a shearing force that could force the releasable portion of the second layer to lose its bond and rotate with the cap which would cause the second layer to pleat against the fixed portion resulting in leakage and opening of the seal. Additionally a tack type releasable adhesive with low adhesion characteristics could also be vulnerable to degradation from the volatile organic compounds present in many petroleum based products that could negatively affect the second layers ability to remain bonded to the first layer when a given pressure is brought to bear.

A fifth method makes use of a single layered non leak proof seal that is bonded over the container opening with a fixed adhesive. The seal contains a weakened fracture pattern with vent holes or an area that is weakened by perforations or creased slits and when sufficient pressure is applied by squeezing the inverted container the seal is forced to burst open and tear only in the configuration of the fracture pattern, perforations or slits as described in embodiments of U.S. Pat. No. 4,938,390 to Markva, embodiments of U.S. Pat. No. 5,353,968 to Good Jr. and U.S. Pat. No. 5,634,504 to Chandler. However, with this method there is no provision given for the problem of the seal leaking through the perforations, slits, or vent holes during shipping or handling. To prevent this, it would be necessary to include an additional seal in the form of a resilient gasket between the closure cap and the seal which would increase the cost of the container. Additionally, the vent holes, slits, or perforations would also leak from the pressure created when the container is gripped and inverted by a consumer which would allow the container contents to drip into the motor compartment making a mess or worse drip onto hot engine components creating noxious fumes and possible fire.

A sixth method makes use of a single layered seal that is bonded over the container opening with a fixed adhesive. The seal contains a weakened breaking pattern that is created by thinning the seal material. Various thinning techniques are employed by the prior art to accomplish this, including; scoring, milling, boring, compression, molding or laser cutting. When sufficient pressure is brought to bear against the seal by squeezing the inverted container, the seal is forced to burst open and tear only in the weaker thinned area of the breaking pattern configuration as described in U.S. Pat. No. 4,949,857 to Russell, and embodiments of U.S. Pat. No. 5,353,968 to Good Jr. However, using any of the various techniques described in these two prior art patents to fabricate a thinned breaking pattern that will leave the precise material thickness necessary for the seal to remain intact when the filled container is lightly gripped and inverted, and then consistently burst at a squeezing pressure that by necessity has to be very low, present considerable manufacturing and fabrication drawbacks described herein.

The burst pressure of the seal cannot be determined by the maximum amount of squeezing force that a consumer can comfortably apply to the inverted container. The higher the burst pressure of the seal, the more likely the volume of liquid gushing out of the container pour spout will exceed the inflow capacity of the fill opening which will cause the liquid to back up and overflow when the seal bursts open. Therefore it is essential that the amount of additional squeezing force necessary to burst open the seal when the container is held by a consumer in the inverted position must be kept as close to zero as possible, while still leaving the seal strong enough to remain intact when the filled uncapped container is gripped and inverted.

Additionally, the laws of fluid dynamics dictate that because the bore of the container is many times greater than the bore of the pour spout opening, the squeezing pressure applied to the container will also be many times greater than the pressure that the squeezing action brings to bear against the seal. This has the effect of multiplying the amount of squeezing pressure necessary to burst the seal and, consequently, will equally increase the internal pressure of the container and the volume of liquid gushing out of the pour spout when the seal breaks open. This further adds to the requirement that any additional thickness of material in the thinned area greater than that necessary for the seal to remain intact when the container is gripped and inverted, must be kept to the absolute minimum that is practically attainable.

When the uncapped container is inverted, the weight of the liquid contents together with the additional pressure created by a consumer gripping the container, produces lateral force that pushes against the seal. This lateral force creates tension in the seal that is opposed by the tensile strength of the seal material. For the seal to burst the lateral force must be increased to a degree sufficient to overcome the tensile strength of the seal material in the thinner area of the breaking pattern. The tensile strength of the seal material, and henceforth the amount of container pressure required to burst the seal, is determined by the type of material used and its thickness in the thinned area. When the tensile strength of the seal material being used and the required burst pressure of the seal are known, the exact minimum material thickness necessary for the seal to remain intact when the container is gripped and inverted, can be determined.

For example, because of its reliability, low cost, and adaptability to high speed fabrication and installation, the packaging industry has universally adopted induction sealing as the method of choice for installing closure seals on many types of containers including those used for pourable motor vehicle additives.

One such type of induction bonded container seal is comprised of a layer of metal foil with one side coated with a layer of hot melt adhesive. The opposite side of the foil seal can be laminated to a layer of absorptive material, such as pulp board, with a layer of heat releasable adhesive, such as micro crystalline wax. The assembled seal disk is inserted into the closure cap which is then installed over the pour spout opening. This presses the hot melt adhesive side of the seal against the container rim. The container is then passed through an induction sealer that generates a high voltage field which is conducted by the metal foil layer of the seal causing it to heat up. The hot foil layer in turn melts the hot melt adhesive layer which bonds the seal to the container rim and simultaneously melts the wax layer which is then absorbed into the pulp board thereby releasing the seal. The pulp board is then retained in the cap when it is removed from the container leaving only the foil seal bonded over the container opening.

Another type of seal that is induction bonded to the container rim in the same manner is comprised of a layer of metal foil with one side coated with a layer of hot melt adhesive. The opposite side of the foil seal can be permanently laminated to one or more layers of various materials, such as synthetic foams, papers, polymer films, plastics, etc. that perform different functions such as providing even compression against the container rim or stiffening the seal to provide resiliency for peripheral tabs that allow the seal to be retained in the closure cap without using releasable layers.

Because of its high conductivity, high strength to weight ratio, low cost, and other desirable qualities, aluminum is used almost exclusively in the industry for the foil layer Excluding the hot melt adhesive layer, which is generally thicker and stronger than the foil layer, the aluminum foil used for these seals is typically a few thousandths of an inch thick. Based on the volumetric weight of the contained liquid and the width of the pour spout opening of a typical container of the type described herein, the pressure produced and brought to bear against the seal when the container is lightly gripped and inverted can be held by an adhesive free single layered aluminum foil seal with a thin breaking pattern that measures approximately one ten thousandth of an inch thick (0.0001") and is herein referred to as the base thickness. Even a base thickness of two ten thousandths of an inch (0.0002") produces a bursting pressure that is far too high. Therefore, in order for the seal to consistently burst with the minimal amount of additional container pressure required, the base thickness of the seal material in the thinner area of the breaking pattern must be able to be adjusted with an accuracy that approaches one one hundredth thousandth of an inch thick (0.00001"), and if other types of seal material are used, the base thickness of the breaking pattern using those materials would also have to be able to be adjusted with similar dimensional accuracy in order for the seal to burst at the precise pressure required.

As can be seen, setting the exact burst pressure necessary for a self opening seal to function properly requires a seal design that allows the process of thinning the material to form the breaking pattern to be controlled with extreme precision. When a weakened breaking pattern has to be created by thinning an area of the seal material to approximately one ten thousandth of an inch thick, within tolerances approaching one one hundredth thousandth of an inch (0.00001"), as is the case with aluminum foil, each of the various thinning schemes used in the prior art patents such as; scoring, milling, boring, compression, molding, or laser cutting fail to provide the control necessary to meet these requirements.

For example, forming the thinned area of the breaking pattern in the seal material by scoring requires that some type of cutting tool be drawn across the surface of each individual seal. This requires that the scoring tool must be kept approximately one ten thousandth of an inch above the bed of a scoring machine as it cuts a relatively deep breaking pattern into a thin layer of delicate seal material while also keeping the depth of the score within tolerances approaching one one hundredth thousandth of an inch. It should be immediately obvious even to those unskilled in the art, that the seal material will most likely tear when this is attempted. Even if this could be accomplished at all, it would be a very time consuming process that would most likely produce quality control problems, a high defect rate and cause inconsistent burst pressures from one seal to the next.

To form the thinned area of the breaking pattern by boring or milling requires that a rotating cutter be kept approximately one ten thousandth of an inch above the bed of a machine tool as it cuts a relatively deep breaking pattern into a thin layer of delicate seal material while also trying to maintain the depth of the cut to within tolerances approaching one one hundredth thousandth of an inch. Again, it should be immediately obvious even to those unskilled in the art that the seal material will most likely tear when this is attempted. Even if this could be accomplished at all, it would also be a very time consuming process that would again, most likely produce quality control problems and a high defect rate and cause inconsistent burst pressures from one seal to the next.

Creating the thinned area of the breaking pattern by compression would require that some type of die, knife edge or V shaped anvil be pressed into various seal materials. Again, the ability to consistently control the depth of a groove that leaves the thinned area of the breaking pattern with the extremely thin and precise dimension necessary for the seal to function properly is beyond the capabilities of a die press. Drawbacks such as allowable machine tolerances or incremental tool wear alone would be sufficient to also produce defects that could cause inconsistent burst pressures from one seal to the next.

Manufacturing a self opening seal with a thinned breaking pattern using a molding process such as injection or vacuum forming requires the seal to be fabricated from heated plastic material which presents a number of significant disadvantages. Each seal must be made individually and cannot be stamped out from roll stock in a high speed fashion. Because of the elasticity and expansion coefficient of plastic materials, the ability to consistently control the depth of the thinned area of the breaking pattern to the tolerances required is beyond the capabilities of either process. Injection molding and vacuum forming also require expensive multi cavity molds that must be replaced regularly adding to the unit cost of each seal. Additionally, manufacturing the closure seal by molding is a time consuming process which would also add to the unit cost of each seal.

Creating the thinned area of the breaking pattern by laser cutting would present different but even more intractable problems. Attempting to melt the seal material to a particular depth with a laser will not produce a precisely thinned breaking pattern. An industrial laser is ideally suited to cutting completely through any type of material in a very precise manner, for instance, to create slits or perforations, but it is inefficient when attempting to use it as a scoring device or milling machine. The process of thinning the seal material by the use of a laser requires the beam to be of sufficient heat to vaporize the seal material to a precise depth. A laser beam that is hot enough to vaporize any type of seal material would not just stop at a certain depth when the laser is either pulsed or moved across the surface. Vaporizing the seal material with the use of a laser is an explosive event that would not leave the precisely thin and delicate layer of intact material necessary for the seal to function properly, if it left any material at all. This method would also be a time consuming process that would add to the unit cost of each seal.

As can be seen when U.S. Pat. No. 4,949,857 to Russell and U.S. Pat. No. 5,353,968 to Good Jr. are closely examined, each falls far short of providing a self opening seal structure that allows the thickness of the material in the thinned area of the breaking pattern to be controlled with the precision necessary for the seal to consistently burst at the precise pressure required. Additionally, the structure of each of the seal embodiments require fabrication methods do not allow the closure to be easily manufactured in a high speed manner that will produce a defect free seal at the lowest possible cost.

In addition to the aforementioned drawbacks in all of the prior art patents, a further drawback is the inability of any of the closure seal embodiments to be manufactured and bonded over a container opening by using the existing induction sealing process which is a significant disadvantage.

For instance, the closure seal of U.S. Pat. No. 4,696,328 to Rhodes Jr. is fabricated from thin rupturable plastic that will not conduct a high voltage current.

The closure seal of U.S. Pat. No. 4,789,082 to Sampson uses both a first fixed adhesive that would have to be a hot melt type and a second releasable adhesive that could migrate to the area between the fixed adhesive and the rim when the closure cap is rotated under pressure which could degrade the ability of a hot melt adhesive to provide a proper bond.

The closure seal of U.S. Pat. No. 4,938,390 to Markva uses variations of two different self opening designs. A first design consists of a one or two layered seal that uses both a first fixed adhesive that would have to be a hot melt type and a second tacky releasable adhesive that could migrate to the area between the fixed adhesive and the rim or between the fixed adhesive of a first layer and a second layer when the closure cap is rotated under pressure which could degrade the ability of a hot melt adhesive to provide a proper bond. A second design consists of a single layered seal containing what appears to be various perforated tear line configurations. The hot melt adhesive layer used to bond an induction seal to a container rim becomes viscous when melted which could cause the adhesive to reseal the perforations of the tear lines and prevent the seal from bursting. To eliminate this requires that the adhesive be zone specific applied to each individual seal only in the area contacting the rim, an inefficient and time consuming process that cannot be incorporated into the existing induction sealing process.

The closure seal of U.S. Pat. No. 4,949,857 to Russell uses a weakened breaking pattern that would be prevented from bursting by the underlying layer of hot melt adhesive, also requiring the adhesive to be zone specific applied to each individual seal only in the area contacting the rim, again an inefficient and time consuming process that cannot be incorporated into the existing induction sealing process.

The closure seal of U.S. Pat. No. 5,353,968 to Good Jr. uses two variations of two different designs for a self opening seal. A first design consists of a closure seal with a breaking pattern that is weakened by slits or perforations. A second design consists of a closure seal with a breaking pattern that is weakened by being thinned in various ways. Again, the necessary layer of hot melt adhesive prevents both designs from being able to be adapted to the induction sealing process either by resealing the slits or perforations when melted or not allowing the thinned area of the breaking pattern to burst when the container is pressurized. To over come this the hot melt adhesive would also have to be zone specific applied to each individual seal only in the area contacting the rim, again a time consuming process for fabricating large quantities of the closure seal that cannot be incorporated into the existing induction sealing process.

The closure seal of U.S. Pat. No. 5,634,504 to Chandler uses a single layered seal that contains vent holes and what appears to be either a perforated or scored fracture pattern. In either case the necessary layer of hot melt adhesive would again prevent the seal from bursting properly by possibly resealing the narrow perforations when the adhesive melts or preventing the seal from bursting at all if just scored, thereby requiring that there be no adhesive in the area of the scores or perforations. Again, the adhesive would have to be applied in a zone specific fashion only in the area where the seal contacts the rim of the container which cannot be incorporated into the existing induction sealing process.

OBJECTS AND ADVANTAGES

The principal object of the present invention is to provide an improved pressure activated self opening container closure seal that is strong enough to remain intact when the filled uncapped container is gripped and inverted, and also weak enough to burst open when a consumer compresses the inverted container to dispense the liquid contents.

It is a further object of the invention to provide a closure seal that allows the burst pressure of the seal to be precisely set at a container pressure that the average consumer would find easy to apply.

It is a further object of the invention to provide a closure seal that bursts at a precise pressure that is consistent from one container to the next thereby allowing the seal to function as intended with a high degree of reliability.

It is a further object of the invention to provide a container seal that is economical to produce in large quantities in a high speed manner using existing materials, manufacturing equipment, and methods that are familiar to those skilled in the art.

It is a further object of the invention to provide a self opening container seal that is leak proof, adaptable to existing containers and closure caps, and can be installed using the existing induction sealing processes.

It is a further object of the invention to provide a closure seal that can be bonded over the container opening without any adhesive layers interfering with the ability of the seal to open properly.

It is a further object of the invention to provide a container closure seal that allows the broken open portion to remain attached to the container thereby avoiding any contamination of the dispensed contents.

It is a further object of the invention to provide a closure seal that is impervious to the container contents and will maintain its integrity over an extended period of time on the shelf.

It is a further object of the invention to provide a pressure activated self opening closure seal with specific improvements that allow the seal to overcome all of the disadvantages inherent in the prior art.

The invention achieves these and other objectives by constructing the closure seal with two separate layers of sheet material that are permanently bonded together. A layer of weak leak proof frangible sheet material that can be rolled to a precise thickness is bonded to a layer of strengthening sheet material. The layer of strengthening sheet material contains a cut out void configuration forming a breaking pattern that leaves a weakness in the multi layered seal only where the first frangible layer covers over the cut out void area of the breaking pattern. This material arrangement turns the strengthening layer into a break and tear template layer which forces the multi layered seal to burst open and tear only in the single frangible layered area of the breaking pattern when the container is pressurized by a consumer squeezing or striking the container. The use of a separate layer of material to create the thinner area of the breaking pattern allows the bursting pressure of the seal to be set precisely. This is accomplished by the ability of current state of the art multi head rolling mills to produce a continuous roll of the ultra thin frangible layer with the exact thickness and consistency required.

The multi layered structure of the present closure seal invention provides a number of important advantages and essential features vital to the proper functioning of the seal that are not provided in the prior art patents such as:

The seal is leak proof.

The burst pressure of the seal can be precisely set.

None of the bonding adhesive layers interfere with the seals ability to consistently burst open at a precise pressure.

The seal bursts open without any of the seal material contaminating the dispensed contents.

The seal can be installed using existing installation processes.

The seal can be manufactured using existing materials and fabrication equipment.

The seal can be manufactured in a high speed manner with a low unit cost.

These and other objects and advantages of the seal invention can be more fully understood and appreciated by a reading of the following detailed specification.

SUMMARY OF THE INVENTION

The container closure seal of the present invention is specifically concerned with the provision of effective means for sealing over the pour spout opening of flexible containers of the type used for storing and dispensing motor oil, motor vehicle additives or chemicals and the like. The seal invention eliminates the disadvantages inherent in prior art seals and current container design by providing a leak proof frangible seal that bursts open in the configuration of a breaking pattern when a precise amount of internal container pressure is reached when the filled uncapped container is inverted and squeezed or struck by a consumer.

The principal advantages of the invention are achieved by utilizing a seal made up of a first layer of leak proof frangible sheet material that is bonded to an additional layer of strengthening sheet material that contains one or more cut out void configurations forming a breaking pattern that turns the additional layer into a break and tear template layer. Bonding the frangible layer to the template layer strengthens the multi layered seal every where except in the area of the breaking pattern where only the single frangible layer covers over the configuration of the breaking pattern. This multi layered construction forces the frangible layer of the seal to break open and tear only in the weaker area of the breaking pattern when sufficient internal container pressure is applied to the seal. When the seal bursts open, the configuration of the breaking pattern also forms one or more connectors that keeps the broken open central portion of the seal attached to the annular section of the seal remaining bonded to the rim of the container pour spout thereby eliminating any contamination of the dispensed contents.

The principal feature of the invention is to provide a leak proof self opening frangible seal for the dispensing opening of the container pour spout that is both, strong enough to remain intact when the seal is subjected to the pressure created when a consumer grips and inverts the filled uncapped container, and also, weak enough to burst open when a certain amount of additional pressure is applied to the seal when a consumer squeezes or strikes the inverted container. This allows the dispensing pour spout to be inserted into a fill opening without spilling any of the liquid contents thereby eliminating the need for a fill funnel.

REFERENCE NUMERALS IN DRAWINGS

Figure 1:
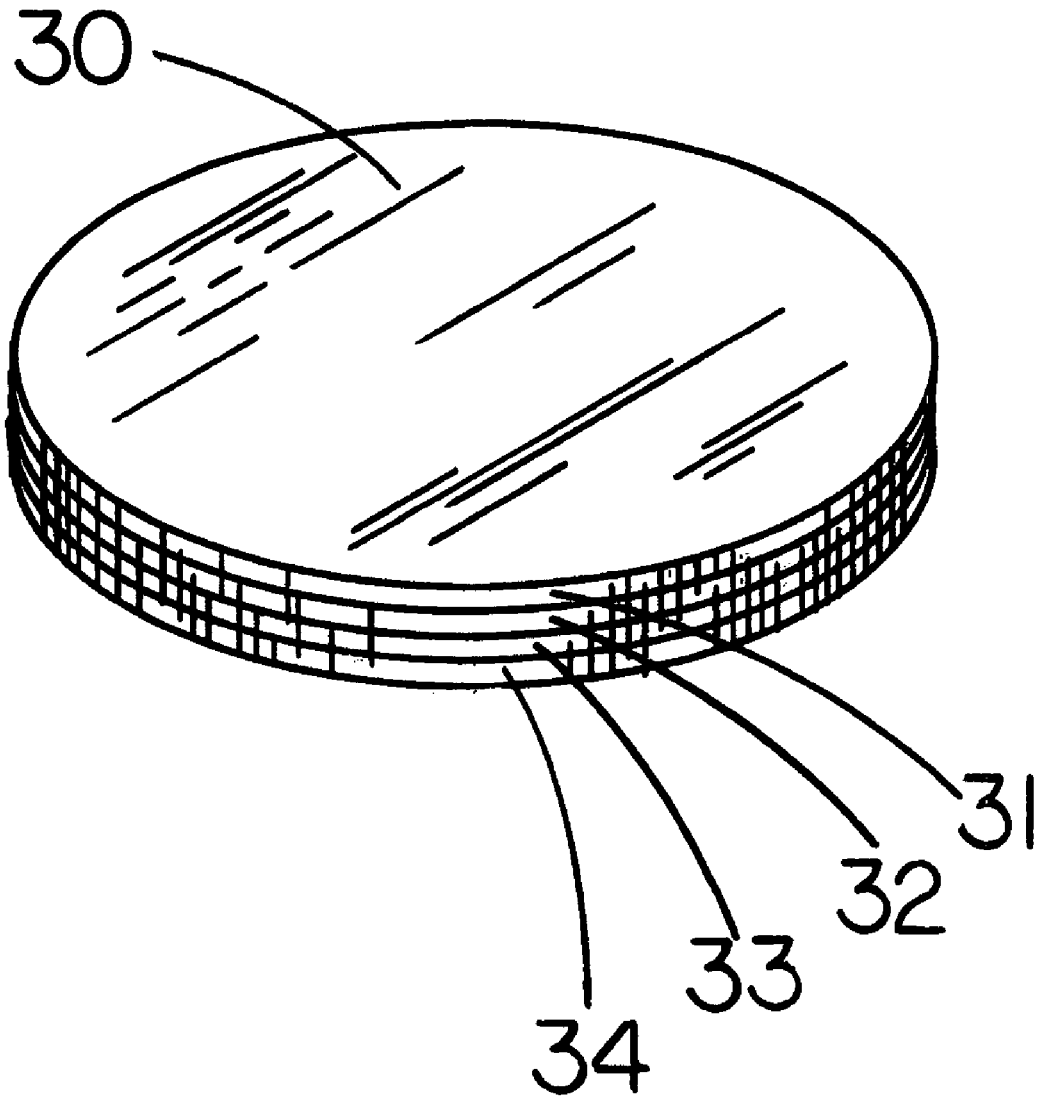
FIG. 1 illustrates a perspective view of a pressure activated self opening multi layered frangible container closure seal.

30. Seal
31. Frangible layer
32. First adhesive layer
32A. Additional adhesive layer
33. Strengthening template layer
33A. Additional strengthening layer
34. Second adhesive layer
35. A thru L a plurality of differing breaking pattern configurations
36. Surface area
37. Uncut area
38. Flap
39. Peripheral portion
40. Pour spout
41. Pour spout dispensing opening
42. Container
43. Container body portion
44. Container bottom end
45. Container bottom wall end
46. Container top end
47. Pour spout rim
48. Closure cap
49. Fill opening
50. Additional material layer
51. Releasable adhesive layer
52. Inner planar surface of closure cap
53. Strip with centered breaking patterns
54. Strip with random breaking patterns
55. Peripheral retaining tabs
56. Inner screw threads of closure cap
57. Inner retaining flange of closure cap
58. Container bellows
59. A thru D a plurality of differing closure seal shapes

DETAILED DESCRIPTION OF THE PREFERRED EMBODIMENTS

Referring now to the drawings, wherein like reference numerals designate corresponding structure through out the views, and in particular referring to FIG. 1 which illustrates a perspective view of an embodiment of a leak proof pressure activated self opening frangible closure seal 30, herein referred to as closure seal 30, for sealing over the pour spout 40 opening 41 of flexible containers 42 of the type used for the storage and dispensing of various pourable liquids such as motor oil, transmission fluid, or chemicals and the like. Closure seal 30 is only of sufficient strength to remain intact when the filled uncapped container 42 is lightly gripped by a consumer and held in an inverted position, while at the same time closure seal 30 is also of sufficient weakness to break open in a specific configuration and dispense the liquid contents when the internal pressure of container 42 is further increased by a consumer squeezing or striking the inverted container 42.

Figure 2:
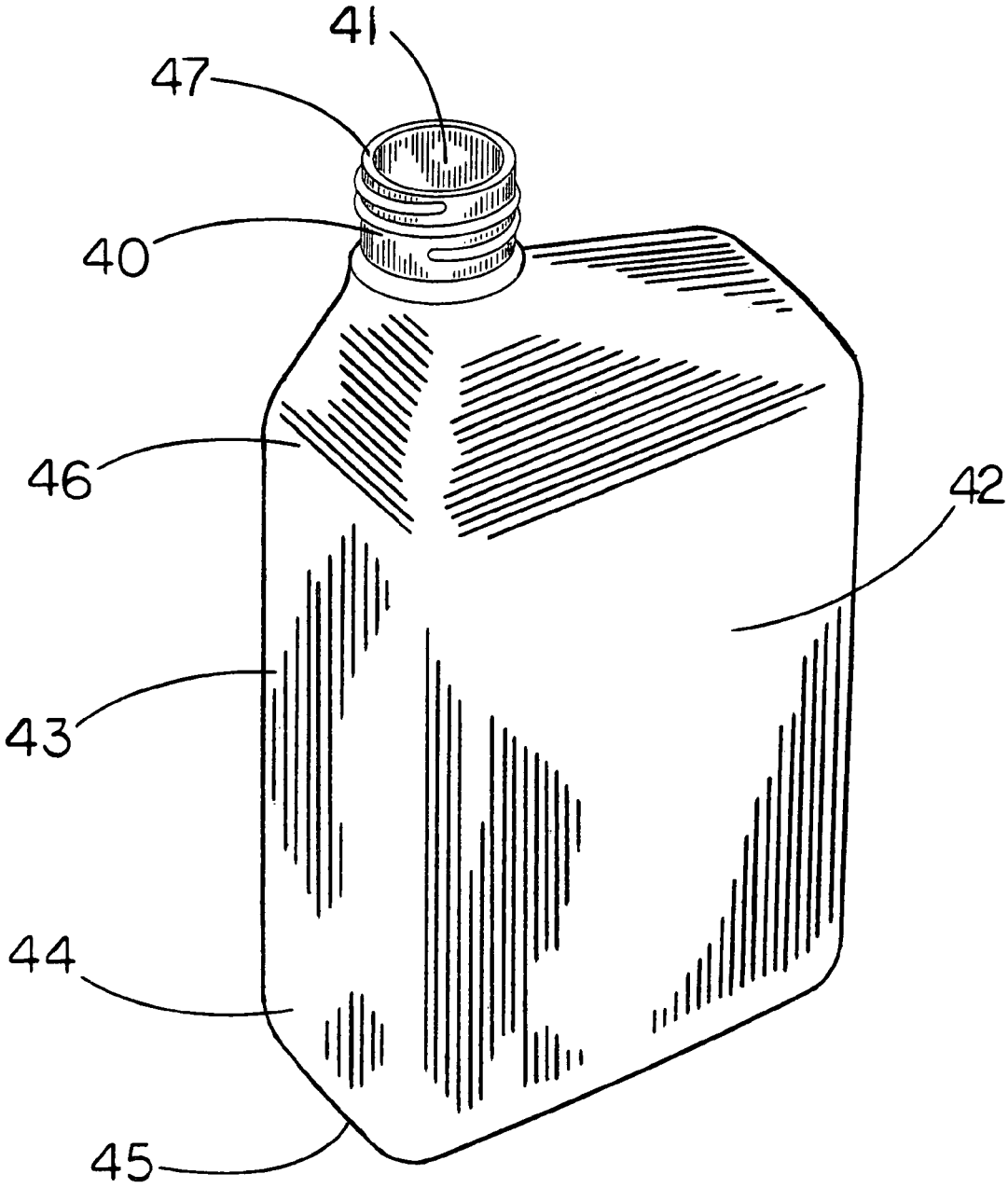
FIG. 2 illustrates a perspective view of a flexible container that is to be sealed with the closure seal invention.

Referring now to FIG. 2 which illustrates a perspective view of an embodiment of a flexible container 42 comprised of a tubular body portion 43 with a bottom end 44 sealed by an integral wall end 45 and an opposite top end 46 forming a pour spout 40 with a dispensing opening 41 that ends with a perpendicular exterior rim 47 that provides a surface area for bonding closure seal 30 over dispensing opening 41.

Figure 2A:
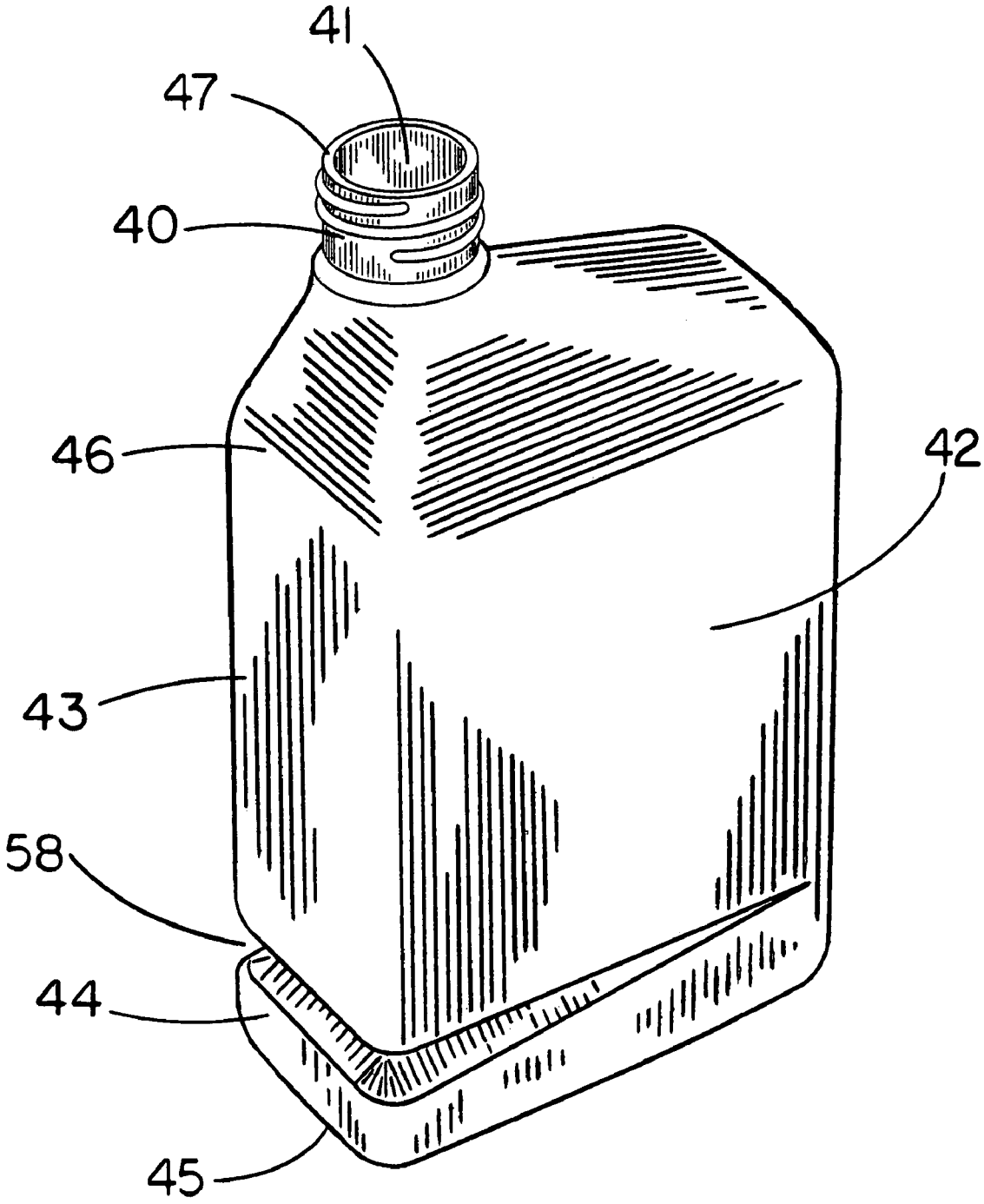
FIG. 2A illustrates a perspective view of a second embodiment of a flexible container that is to be sealed with the closure seal invention that includes integral bellows which allows the container to be compressed.

FIG. 2A illustrates a perspective view of a second embodiment of container 42 that includes an integral bellows 58 that allows container 42 to be compressed.

Figure 3:
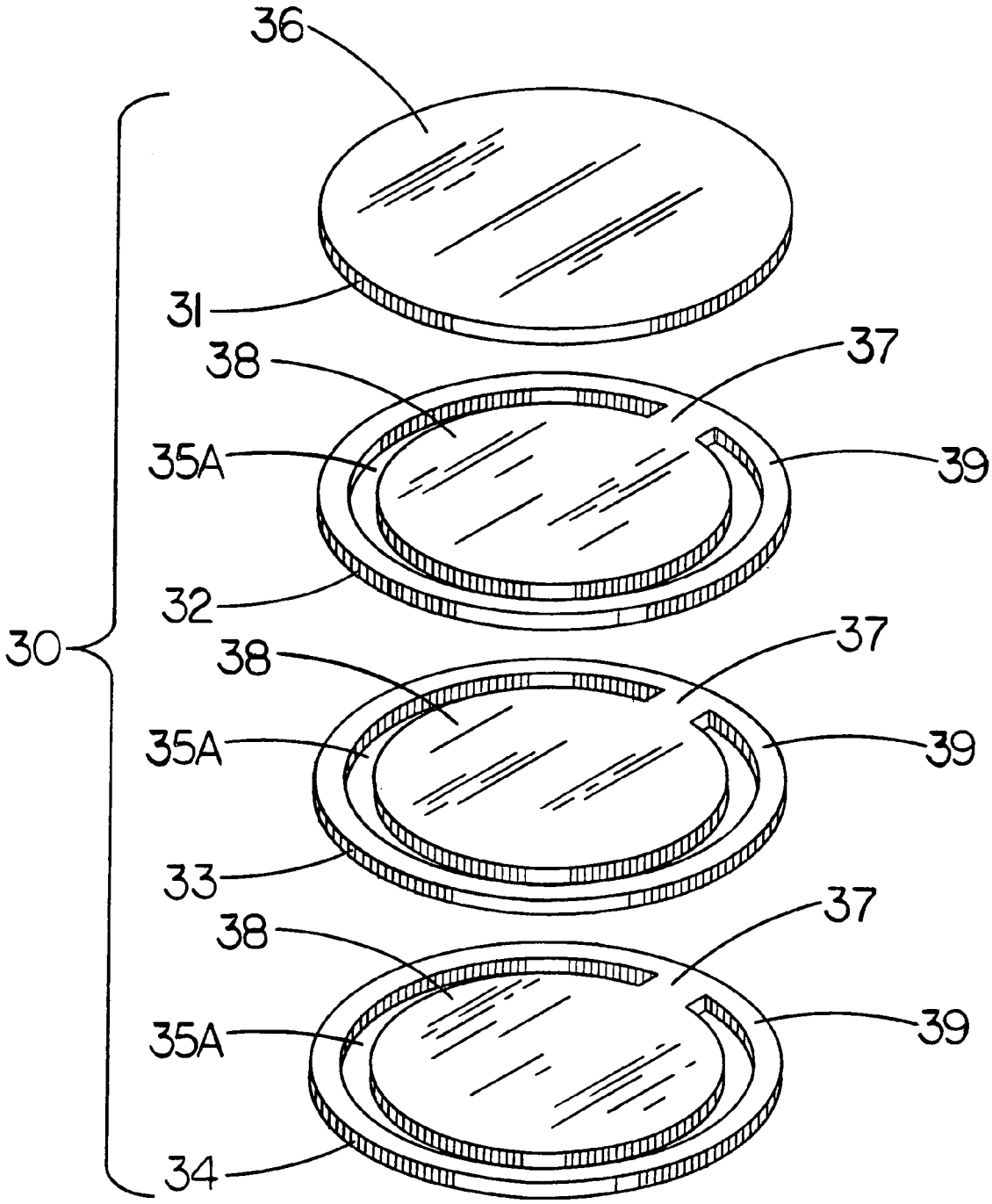
FIG. 3 illustrates an exploded view of the multi layered closure seal showing the differing individual layers.

FIG. 3 illustrates an exploded view of closure seal 30 constructed of a first layer 31 of breakable sheet material, herein referred to as frangible layer 31, comprised of one or more layers of either; metal foil, polymers, plastic, paper, or combinations thereof. Frangible layer 31 is bonded by a second layer 32 of material comprised of adhesive, to a third layer 33 of strengthening sheet material comprised of one or more layers of either; metal foil, polymers, plastic, paper, adhesive, or combinations thereof and herein referred to as template layer 33. A fourth layer 34 of material comprised of adhesive enables seal 30 to be bonded over pour spout 40 dispensing opening 41 of container 42 by various means such as, but not limited to; heat, ultrasonic, reactive, evaporative, pressure sensitive, or induction sealing.

Figure 4:
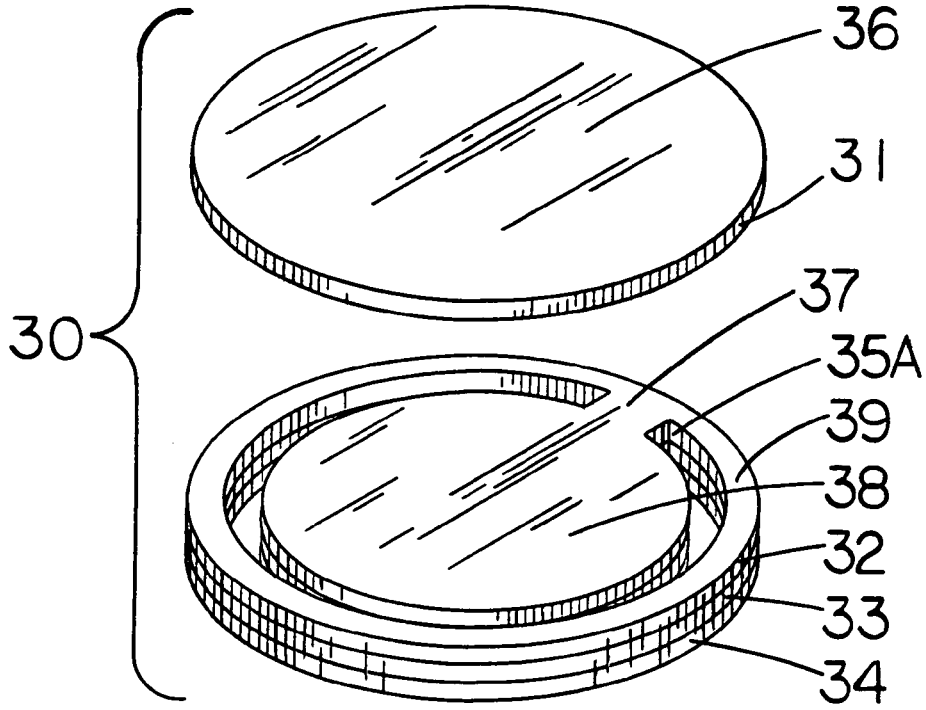
FIG. 4 illustrates a partially exploded view of the multi layered closure seal showing the structural function of each of the individual layers.

As further shown in the exploded view of FIG. 3 and the partially exploded view of FIG. 4, template layer 33 together with adhesive layers 32 and 34 respectively, each contain a variable cut out void configuration forming flap 38 and herein referred to as breaking pattern 35A. Breaking pattern 35A can be cut into template layer 33 that has either none, one, or both adhesive layers 32 and 34 already applied which allows duplicate breaking pattern 35A configurations to be cut into template layer 33 and either, none, one, or both adhesive layers 32 and 34 respectively, in a single step or, after breaking pattern 35A is cut into template layer 33, either one or both adhesive layers 32 and 34 can be applied to template layer 33 by various means known to those skilled in the art such as, but not limited to; spraying, rolling, or thin film application. In either process there is no adhesive spanning the cut out void area of breaking pattern 35A configuration that has been cut into template layer 33 as further shown in FIG. 4.

Referring back to, and as further shown in FIG. 1, frangible layer 31 is then bonded to template layer 33 and adhesive layer 34 by adhesive layer 32 to form seal 30 that is comprised of multiple layers everywhere, except in the area of breaking pattern 35A where seal 30 is comprised of only frangible layer 31 that must be broken to break open seal 30.

Figure 5:
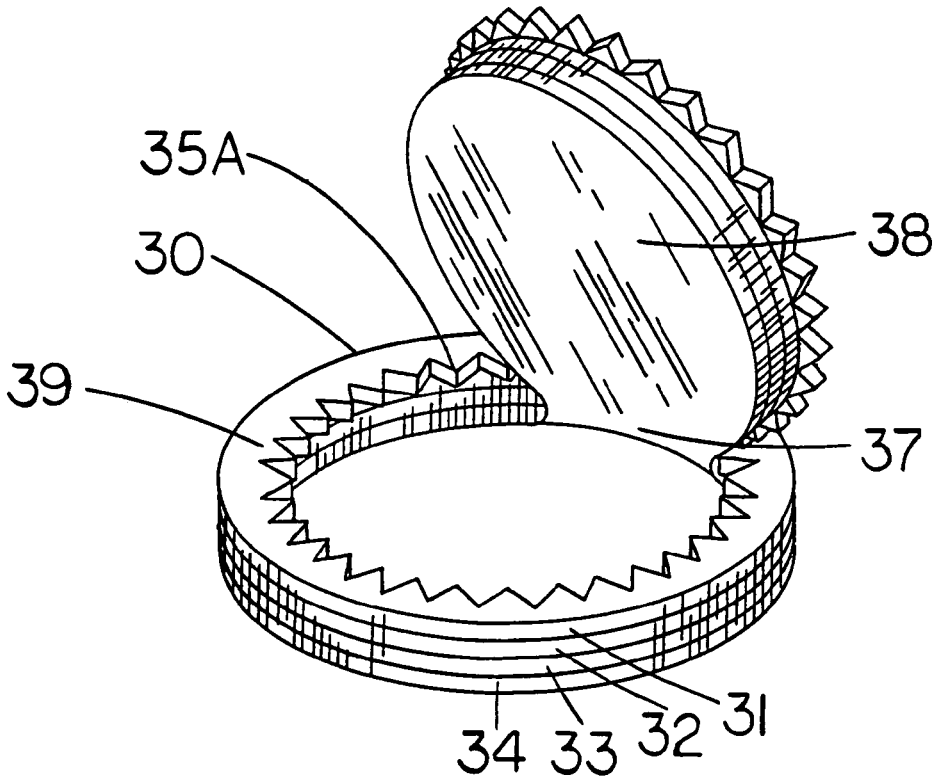
FIG. 5 illustrates a perspective view of the closure seal invention in a broken open condition.

As shown in FIG. 5 this multi layered construction leaves the surface area 36 of seal 30 relatively weaker only in the area where frangible layer 31 covers over the area of the configuration of breaking pattern 35A while making the remaining multi layered surface area 36 of seal 30 relatively stronger. This forces seal 30 to break open only in the weaker single frangible layer 31 area of the configuration of breaking pattern 35A to form flap 38 when sufficient internal container 42 pressure is brought to bear against seal 30 as further shown in perspective in FIG. 5.

Figure 6:
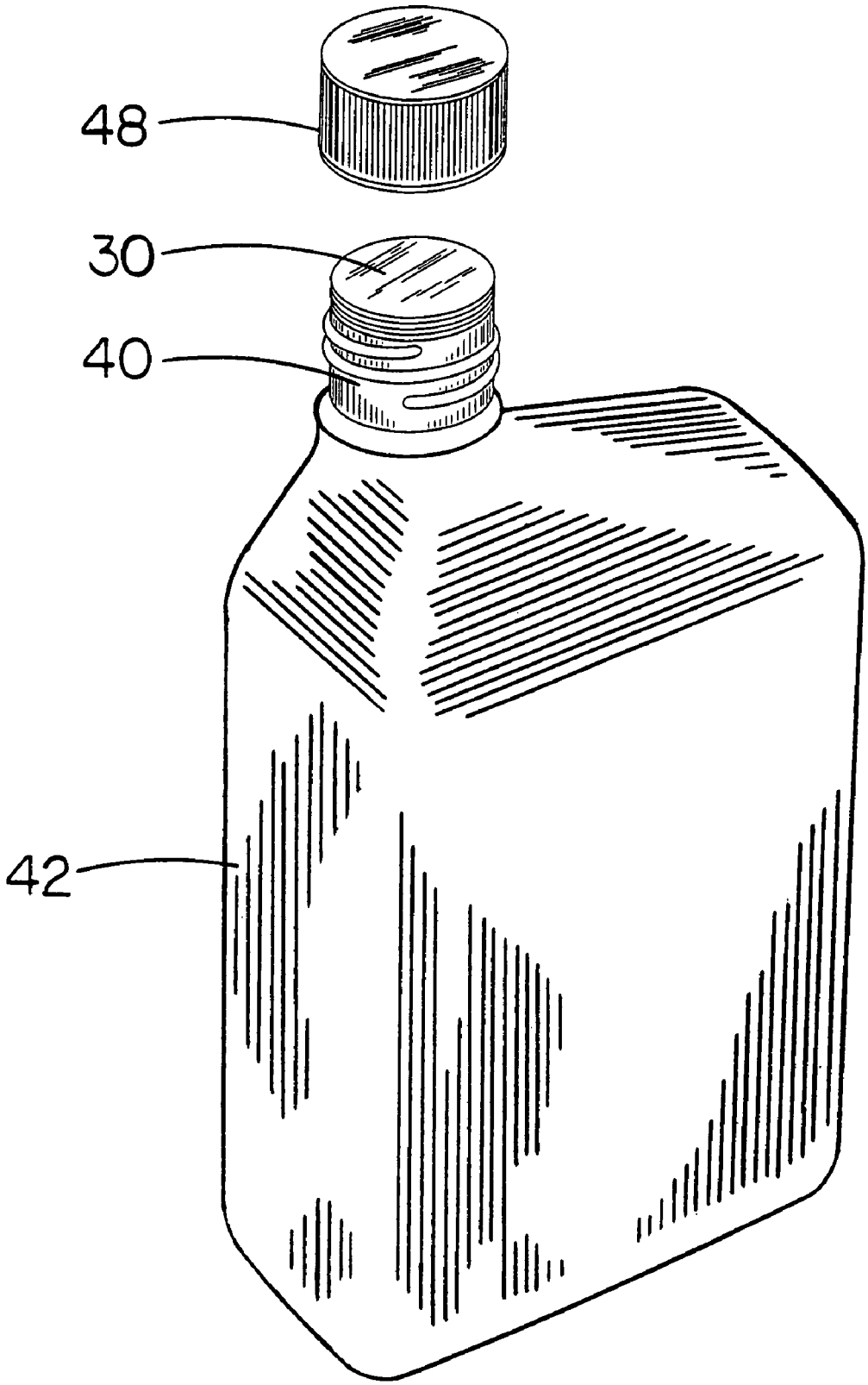
FIG. 6 illustrates a perspective view of the closure seal installed on a flexible container with an accompanying closure cap.

Now looking at FIG. 6, there is shown a perspective view of container 42 with seal 30 invention bonded over pour spout 40 opening 41 providing a leak proof closure 30. Pour spout 40 can also include means for attaching a conventional closure cap 48. Closure cap 48 can be secured by using screw threads as further shown in FIG. 6, or closure cap 48 may be attached by various other means such as pressure fitting.

Figure 7:
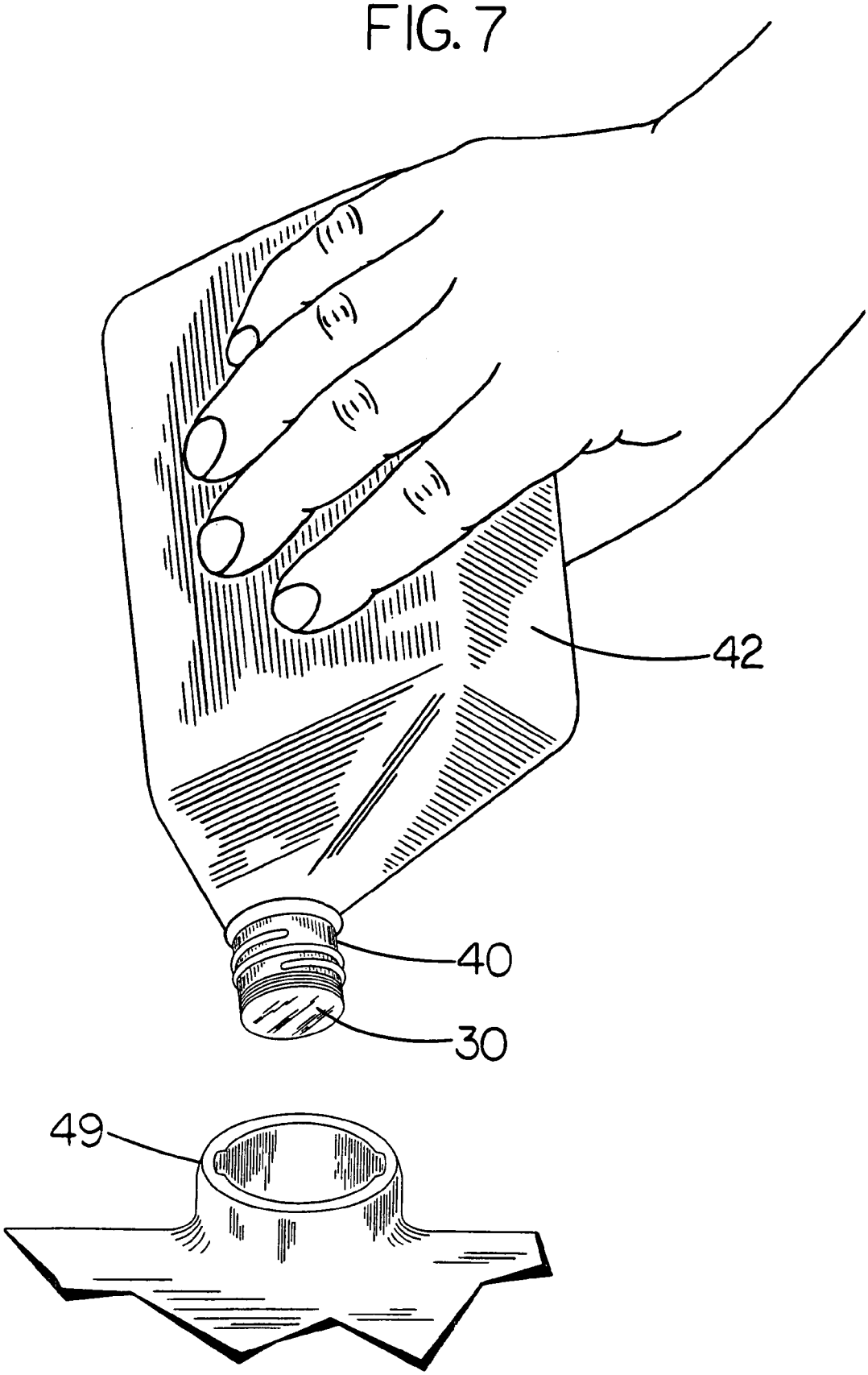
FIG. 7 illustrates a perspective view of the installed closure seal remaining intact while the filled container is held in an inverted position by a consumer.

FIG. 7 shows that when closure cap 48 is removed, seal 30 is of sufficient strength to remain intact when subjected to the pressure created by the weight of the liquid contents and the additional internal container 42 pressure generated when a consumer grips and holds container 42 while held in an inverted position which prevents the contents from dispensing out from container 42 before pour spout 40 can be inserted into the intended fill opening 49.

Figure 8:
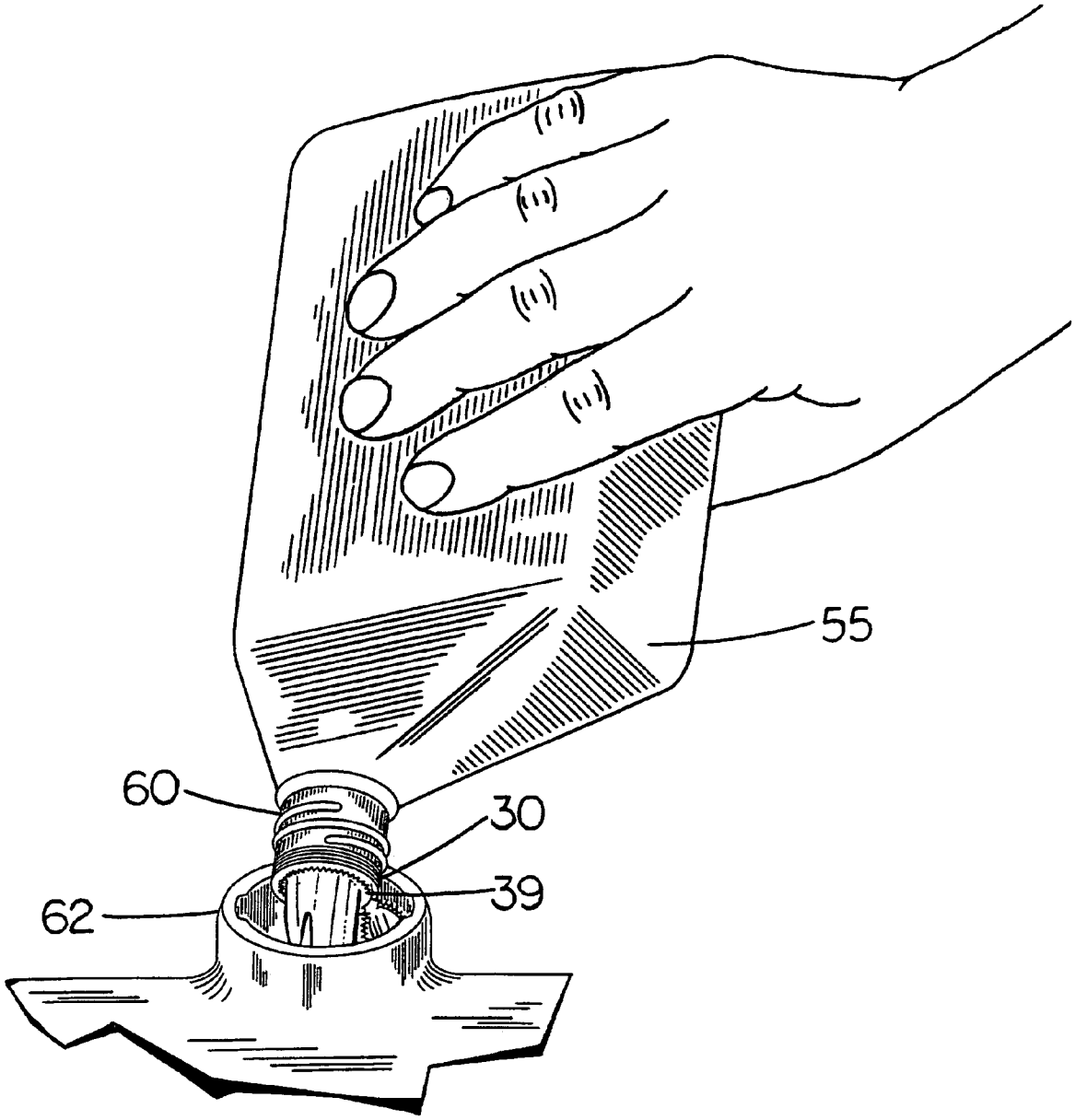
FIG. 8 illustrates a perspective view of the container dispensing the liquid contents after the closure seal is broken open by a consumer squeezing or striking the inverted container.

FIG. 8 further shows that when a set amount of additional internal container pressure is brought to bear against seal 30 by a consumer manually squeezing or striking the filled uncapped container 42 while held in the inverted position, seal 30 is also sufficiently weak enough to break open in the configuration of breaking pattern 35A. to dispense the liquid contents only into the intended fill opening 49 thereby preventing spillage and eliminating the need for an opening device or fill funnel as further shown in FIG. 8.

Looking back at FIG. 4 and FIG. 5, a portion of breaking pattern 35A that forms flap 38 includes an uncut area 37 that can serve multiple purposes. First, uncut area 37 acts as a hinge that allows flap 38 to swing outward after being broken open, and at the same time holds flap 38 in the open position. Second, uncut area 37 serves as a connector that keeps the open flap 38 from tearing away from the peripheral portion 39 of seal 30 remaining bonded to pour spout 40 rim 47 and contaminating the contents of container 42 when dispensed as further shown in FIG. 8. If desirable, uncut area 37 can also serve as a connector that allows a consumer to pull flap 38 and the peripheral portion 39 of seal 30 from rim 47 when a lower bonding strength adhesives is used for layer 34 thereby allowing container 42 to be recycled without being contaminated by any of seal 30 material.

Figure 9:
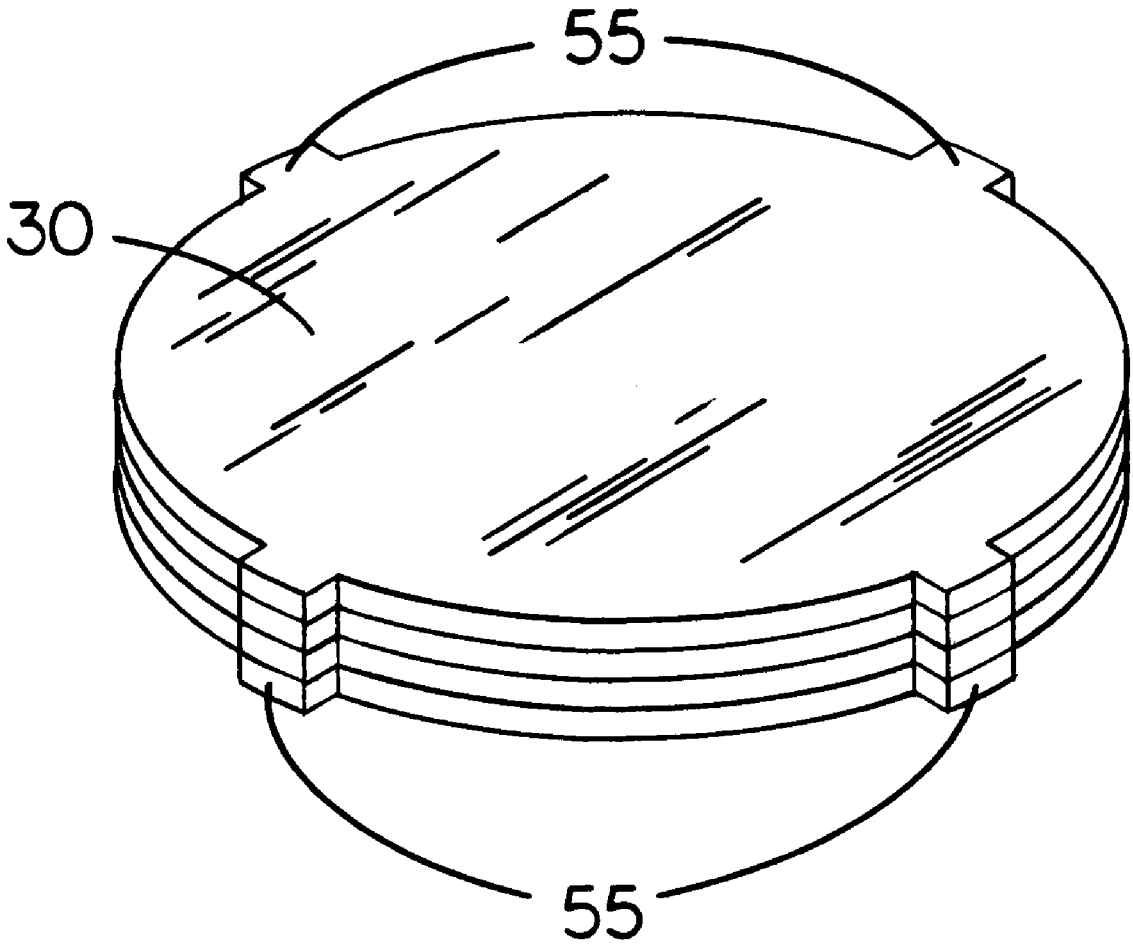
FIG. 9 illustrates an perspective view of an embodiment of the closure seal showing peripheral tabs that allow the seal to be inserted and retained in a closure cap.
Figure 10:
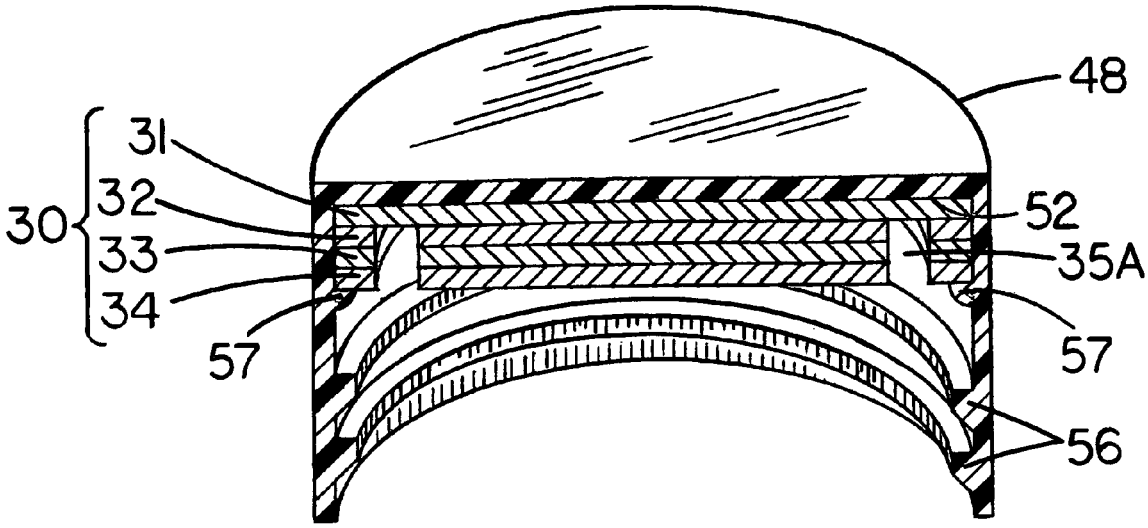
FIG. 10 illustrates a sectional view of the closure seal inside a closure cap with screw threads and a retaining flange either of which can be used to retain the embodiments of the closure seal in the closure cap providing means to install the seal over the pour spout opening.

As shown in FIG. 9 an additional embodiment of seal 30 can include one or more peripheral tabs 55 providing means for seal 30 to be inserted and retained within closure cap 48 by either protruding screw threads 56 or by retaining flange 57 that project from the inner side wall of closure cap 48 thereby allowing seal 30 to be bonded to pour spout 40 rim 47 by induction sealing or other means as further shown in the sectional view of FIG. 10.

Figure 11:
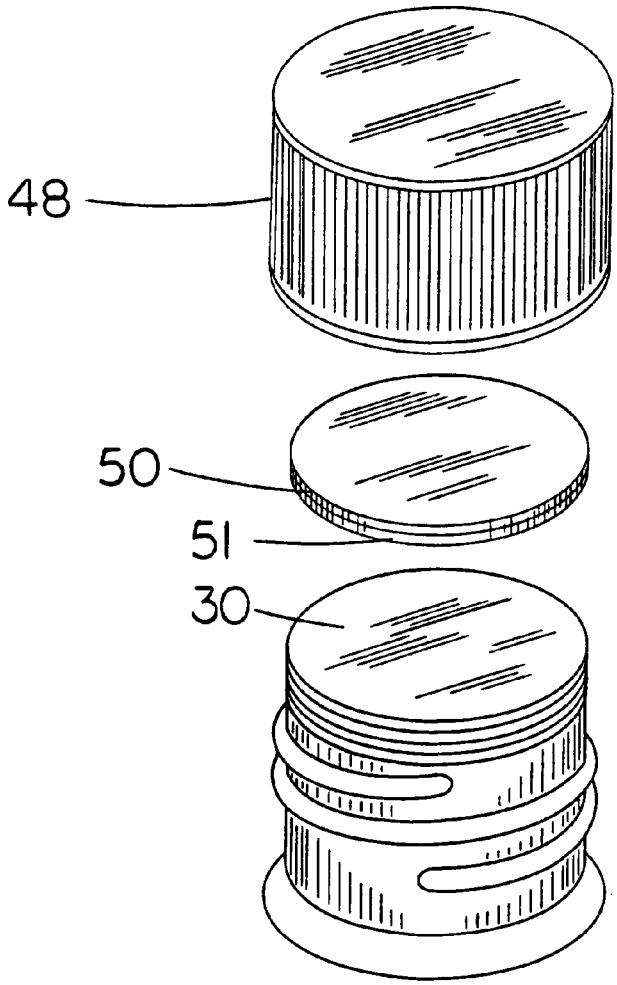
FIG. 11 illustrates an exploded view of the closure seal installed over the pour spout opening of a flexible container showing additional layers of sheet material that allow the closure seal to be inserted into the closure cap as a single disk and installed by using the induction sealing process.

As shown in the partially exploded view of FIG. 11, seal 30 can also include one or more additional layers of material providing means for seal 30 to be bonded over container 42 pour spout 40 opening 41 by induction heat sealing. A first layer of additional stiffening material 50 comprised of one or more layers of either; pulp, polymers, absorbent material or combinations thereof, is bonded to seal 30 by a second layer of additional material 51 consisting of a releasable adhesive. Bonding layer 50 to seal 30 with releasable adhesive layer 51, allows seal 30, in combination with layers 50 and 51 to be inserted and held inside container 42 closure cap 48 which is then secured over pour spout 40 opening 41 of container 42 as further shown in the sectional view of FIG. 12. Although not shown in the drawings, additional layers 50 and 51 can also include peripheral tabs 55 providing means for seal 30 to be inserted and held within closure cap 48 by either screw threads 56 or flange 57

Container 42 is then passed through an induction sealer which heats seal 30 to a temperature sufficient to bond seal 30 to pour spout 40 rim 47 and simultaneously melt releasable adhesive layer 51 which is then absorbed into stiffening layer 50 thereby releasing seal 30 from stiffening layer 50. Stiffening layer 50 is then retained inside closure cap 48 after the removal of closure cap 48 from pour spout 40 leaving only seal 30 bonded over opening 41 as further shown in FIG. 6.

Figure 12:
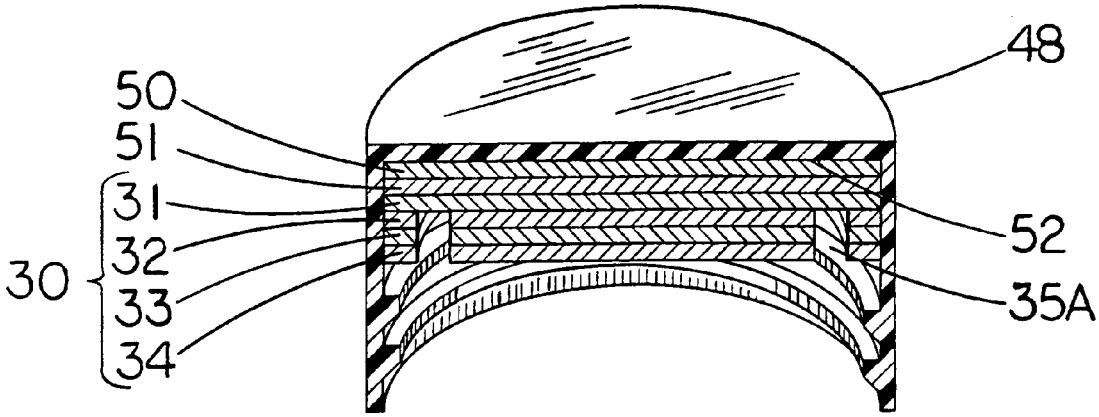
FIG. 12 illustrates a sectional view of a closure cap and the closure seal invention together with additional layers that allow the closure seal to be inserted and retained in the closure cap and installed over a pour spout opening by using the induction sealing process.

As further shown in the cut away view of FIG. 10, and FIG. 12 the inner upper planar surface area 52 of closure cap 48 is substantially flat and when secured to container 42 pour spout 40, is held flat against the outer surface of seal 30, or when included additional layers 50 and 51, thereby preventing seal 30 from breaking open and dispensing container 42 contents prior to removing closure cap 48.

Figure 13:
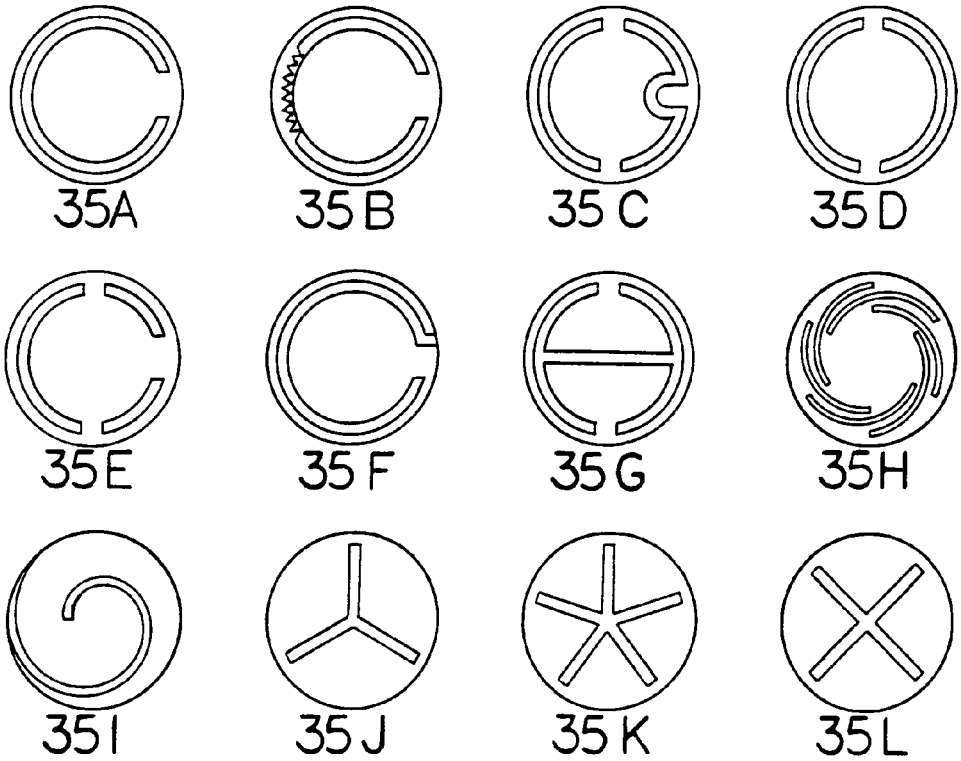
FIG. 13 illustrates a plurality of different configurations 35 A thru L that may be used to form the breaking pattern of the strengthening template layer of the closure seal.

FIG. 13 shows a plurality of different breaking pattern configurations numbered 35A through 35L that may be used to fabricate template layer 33. The configuration of breaking pattern 35A shown in FIGS. 3, 4, 5, 8, 14, and 16, though preferred, is used to illustrate the function of seal 30 invention and not to limit the embodiments described herein only to the breaking patterns shown in the drawings.

Figure 14:
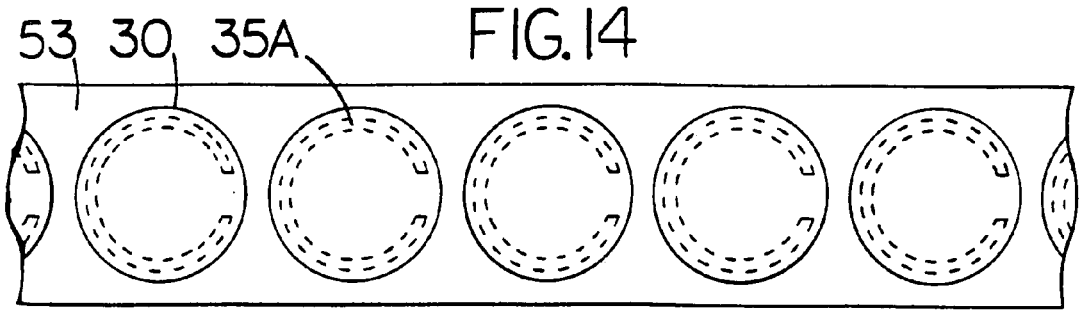
FIG. 14 illustrates a hidden view of repeating breaking pattern configurations that are centered within the closure seal disk as they are die cut out from a continuous strip of the multi layered seal material.
Figure 15:
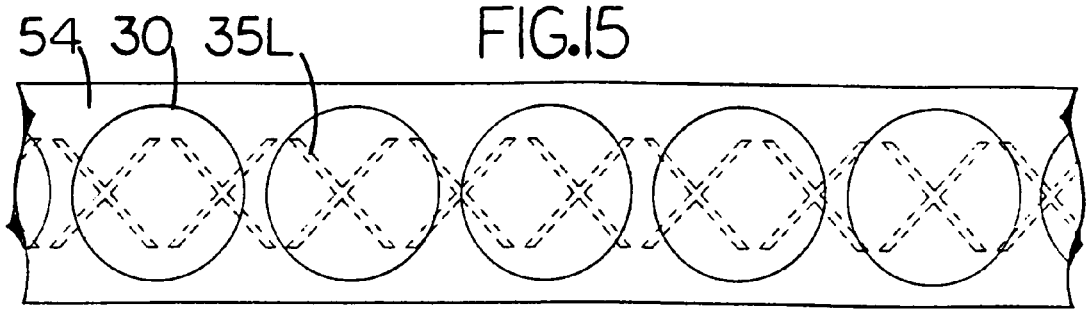
FIG. 15 illustrates a hidden view of repeating breaking pattern configurations that are in close enough proximity to one another to allow the closure seal disks to be cut out from a continuous strip of the multi layered seal material at any point along the strip and contain enough of one or more of the breaking patterns within the circumference of the closure seal disk to allow the closure seal to function properly.

Using breaking pattern 35A, as shown in FIG. 13, seal 30 disk can be cut out of a continuous strip 53 of the multi layered seal material wherein the disk cutter is in register with each individual breaking pattern 35A and cuts out seal 30 disk with a single breaking pattern 35A substantially centered within the circumference of seal 30 disk, as shown in the hidden view in FIG. 14, or, using the breaking pattern 35L as shown in FIG. 13, seal 30 disk can be cut out of a continuous strip 54 of the multi layered seal material wherein breaking pattern 35L is of a size, and is repeated in the strip 54 in close enough proximity to one another, to allow seal 30 disk to be cut out of the strip 54 at any point along the strip 54, and contain enough of one or more of the repeating breaking patterns 35L within the circumference of seal 30 disk for seal 30 to function as intended, when bonded over container 30 opening 41 as shown in FIG. 15.

Figure 16:
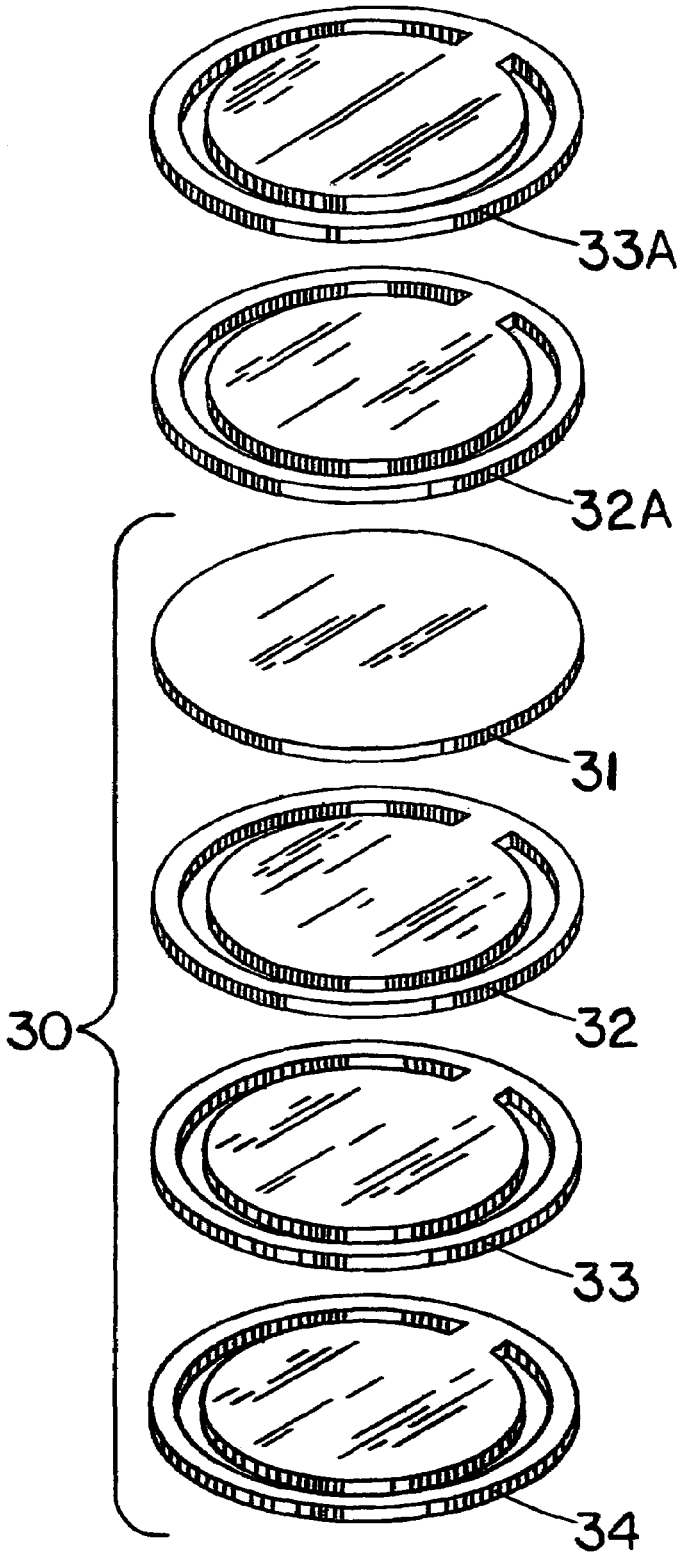
FIG. 16 illustrates an exploded view of an additional embodiment of the multi layered closure seal showing the structural function of additional layers of sheet material.

FIG. 16 illustrates an exploded view of an additional embodiment of seal 30 showing frangible layer 31 bonded to template layer 33 and adhesive layer 34 by adhesive layer 32 with a second template layer 33A bonded to the opposite side of frangible layer 31 by adhesive layer 32A. Seal 30 can then be bonded to rim 47 by adhesive layer 34 using any of the means disclosed in the specification herein.

Figure 17:
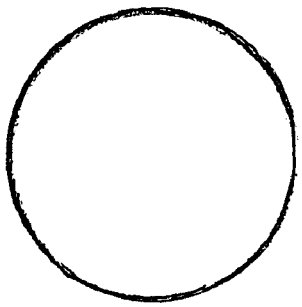
FIG. 17 illustrates a plurality of different peripheral configurations 59A thru 59D that may be used to fabricate the closure seal to fit different shaped container rims.
Figure 17:
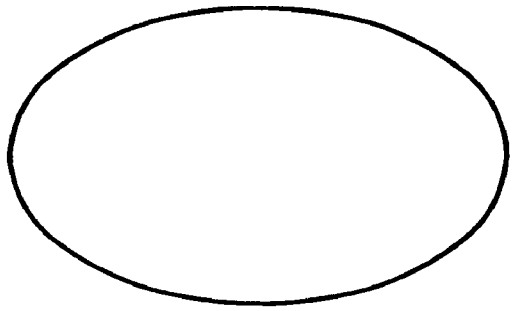
Figure 17:
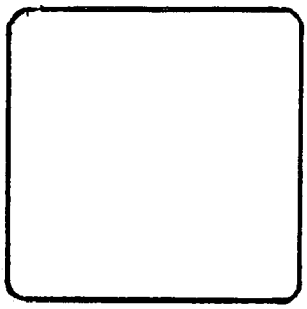
Figure 17:
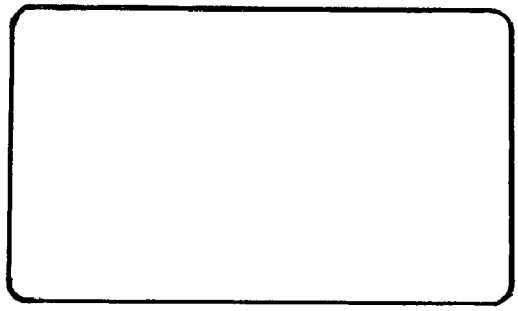

FIG. 17 shows a plurality of different peripheral configurations numbered 59A through 59D that may be used to fabricate seal 30 thereby allowing seal 30 to be bonded to different shaped container 42 rims 47.

Template layer 33 side of seal 30 may be bonded to rim 47 as described herein, or alternately, frangible layer 31 side of seal 30 may also be bonded to rim 47 by applying adhesive to frangible layer 31 only where seal 30 contacts rim 47 or by applying adhesive to rim 47.

Adhesive layer 34 can be eliminated when either; seal 30 is to be bonded to rim 47 by the application of the adhesive to rim 47; or when the frangible layer 31 side of seal 30 is bonded to rim 47.

Adhesive layer 32 can be eliminated when frangible layer 31 is to be bonded directly to template layer 33 by various means known to those skilled in the art such as, but not limited to, cladding or fusion bonding and the like.

When template layer 33 consists of adhesive such as heat seal sheet material, adhesive layer 32, template layer 33, and adhesive layer 34 can be combined and applied to frangible layer 31 in one or more processes. When the combined layers of adhesive are applied to frangible layer 31, breaking pattern 35A is formed by leaving an area in the configuration of breaking pattern 35A uncoated. This leaves surface area 36 of seal 30 relatively weaker only in the uncoated area of the single frangible layer 31 while making the multi layered coated area of seal 30 relatively stronger which forces seal 30, when bonded to rim 47 to break open and tear only in the single weaker frangible layer 31 area of breaking pattern 35A configuration.

Adhesive layers 32 and 34 may be comprised of one or more layers of different types of adhesives such as, but not limited to, sheet heat seal adhesive, hot melt adhesives of the same or differing bonding temperatures, one or more part reactive adhesives, evaporative adhesives, or pressure sensitive adhesives that may incorporate an additional protective peel off layer that is removed after breaking pattern 35A is cut into adhesive layer 32, template layer 33 and adhesive layer 34 in a single step, allowing frangible layer 31 to be then applied to template layer 33 by pressure.

The internal container 42 pressure required to break open seal 30 when bonded to rim 47 can be adjusted by; increasing or decreasing the thickness of the material used in frangible layer 31, by the choice of material used in frangible layer 31, by the configuration of the breaking pattern used in template layer 33, or combinations of one or more of the these. The size and shape of container 42 shown in drawing FIGS. 2, 6, 7, and 8 is used as an example to illustrate the function of seal 30 invention and not to limit the application of the embodiments to a container of a particular size or shape.

Although the present invention has been described in terms of specific embodiments thereof, the invention claimed is not so restricted. It will be apparent to those skilled in the art that it is possible to modify and alter features of the invention while remaining within the spirit and scope of the inventive concept. Variations of the embodiments may be made without departing from the invention in its broader aspect such as: various breaking pattern configurations and dimensions not shown in the drawings may also be used; various other materials not described herein may be substituted for the layers of seal 30; various other adhesives not described herein may be adopted; the construction of container 42 may vary from the illustrations shown in the drawings; container 42 may contain additional types of pourable material; any number of additional alternating frangible 31 or template 33 layers may also be bonded to either side of the multi layered seal 30 invention etc. Thus the scope of the invention should be determined by the appended claims and their legal equivalents, rather than by the examples given.

I claim:

1. A leak proof pressure activated self opening closure seal for sealing over a dispensing opening of a flexible container used for containing and dispensing pourable material, said flexible container comprising:

(a) a tubular body portion with a sealed bottom end, an opposite top end forming a pour spout that includes means for securing a closure cap; said pour spout ending with an exterior rim providing a surface area for bonding said closure seal over said dispensing opening of said pour spout;

(b) said closure seal comprising:

a first layer of frangible sheet material, a second layer of adhesive, a third layer of strengthening sheet material, a fourth layer of adhesive;

(c) wherein said first layer of frangible sheet material, said second layer of adhesive, said third layer of strengthening sheet material, and said fourth layer of adhesive are permanently laminated together forming said closure seal;

(d) wherein said second layer of adhesive, said third layer of strengthening sheet material and said fourth layer of adhesive each contain a duplicate cut out void configuration that are in alignment with each other;

(e) wherein said duplicate cut out void configuration creates a weak area in said closure seal by leaving only said first layer of frangible sheet material covering over said duplicate cut out void configuration;

(f) wherein a peripheral portion of said closure seal is bonded to said exterior rim of said flexible container by said fourth layer of adhesive sealing over said dispensing opening of said pour spout;

(g) wherein said closure seal is of sufficient strength to remain intact and retain said pourable material in said flexible container when said flexible container is gripped, uncapped and inverted by a consumer;

(h) wherein said closure seal is of sufficient weakness to break open only in said weak area of said duplicate cut out void configuration thereby allowing said pourable material to dispense from said pour spout when said flexible container is pressurized by said consumer squeezing or striking said flexible container.

2. The closure cap of claim 1, wherein an inner planar surface of said closure cap is in contact with said closure seal when said closure cap is installed on said flexible container preventing said closure seal from breaking open prior to the removal of said closure cap from said flexible container.

3. The duplicate cut out void configuration of claim 1, wherein said duplicate cut out void configuration includes one or more uncut portions that connect one or more broken open center flaps of said closure seal to said peripheral portion of said closure seal remaining bonded to said exterior rim thereby preventing said one or more broken open center flaps from tearing from said annular portion when said closure seal breaks open.

4. The duplicate cut out void configuration of claim 1, wherein said duplicate cut out void configuration can comprise either a varied C shaped, H shaped, three or more point star shaped, X shaped, wave shaped, spiral shaped, or circular shaped configuration.

5. The closure seal of claim 1, wherein said peripheral portion of said closure seal is bonded to said exterior rim by: induction sealing, heat sealing, evaporative sealing, reactive sealing, or ultrasonic sealing.

6. The first layer of frangible sheet material of claim 1, wherein said first layer of frangible sheet material is made up of one or more layers of same or different materials wherein said materials are: metal foil; polymers; plastic; or paper.

7. The third layer of strengthening sheet material of claim 1, wherein said third layer of strengthening sheet material is made up of one or more layers of same or different materials wherein said materials are: metal foil; polymers; synthetic foam; plastic; paper or adhesive.

8. The closure seal of claim 1, wherein said closure seal can be either; circular, oval, rectangular, or square shaped.

9. The closure seal of claim 1, wherein said closure seal includes one or more peripheral tabs providing means for retaining said closure seal in said closure cap.

10. The closure seal of claim 1, wherein said closure seal includes one or more additional layers of same or different sheet materials, wherein said sheet materials are: metal foil, plastic, polymers, synthetic foam, pulp board, paper, adhesive, or releasable adhesive; providing means for bonding said closure seal to said exterior rim; and wherein said means for bonding comprising induction sealing, heat sealing, evaporative sealing, reactive sealing, or ultrasonic sealing.

11. The first layer of frangible sheet material of claim 1, wherein said first layer of frangible sheet material is permanently laminated to said third layer of strengthening sheet material by non adhesive means, wherein said non adhesive means comprise cladding or fusion bonding.

12. The pourable material of claim 1, wherein said pourable material can be one of motor oil;

transmission fluid, motor vehicle additives, lubricants, or chemicals.

13. The flexible container of claim 1, wherein said flexible container can include integral bellows providing means to compress said flexible container.

14. A leak proof pressure activated self opening closure seal for sealing over the pour spout dispensing opening of a flexible container used for storing and dispensing pourable liquid comprising:

(a) a first layer of strengthening sheet material, a second layer of adhesive, a third layer of frangible sheet material, a fourth layer of adhesive, a fifth layer of strengthening sheet material, a sixth layer of adhesive;

(b) wherein said first layer of strengthening sheet material, said second layer of adhesive, said third layer of frangible sheet material, said fourth layer of adhesive, said fifth layer of strengthening sheet material, and said sixth layer of adhesive are permanently laminated together forming said closure seal;

(c) wherein said first layer of strengthening sheet material, said second layer of adhesive, said fourth layer of adhesive, said fifth layer of strengthening sheet material and said sixth layer of adhesive each contain a duplicate cut out void configuration that are in alignment with each other;

(d) wherein said duplicate cut out void configuration creates a weak area in said closure seal by leaving only said third layer of frangible sheet material in said weak area of said cut out void configuration;

(e) wherein a peripheral portion of said closure seal is adhesively bonded to said exterior rim of said flexible container sealing over said dispensing opening;

(f) wherein said dispensing opening is closed with a closure cap;

(g) wherein said closure cap includes an inner planar surface that is in contact with said closure seal preventing said closure seal from breaking open prior to the removal of said closure cap from said flexible container;

(h) wherein said closure seal is of sufficient strength to remain intact and retain said pourable liquid in said flexible container when said flexible container is gripped, uncapped and inverted by a consumer;

(i) wherein said closure seal is of sufficient weakness to break open only in said weak area of said duplicate cut out void configuration thereby allowing said pourable liquid to dispense from said dispensing opening when said flexible container is pressurized by said consumer squeezing or striking said flexible container while in said inverted position;

(j) wherein said duplicate cut out void configuration includes one or more uncut portions that connect one or more broken open center flaps of said closure seal to said peripheral portion of said closure seal remaining bonded to said dispensing opening thereby preventing said one or more broken open center flaps from tearing from said peripheral portion when said closure seal breaks open;

(k) wherein said duplicate cut out void configuration can comprise either a: varied C shape, H shaped, three or more point star shaped, X shaped, wave shaped, spiral shaped, or circular shaped configuration;

(l) wherein said first layer of strengthening sheet material and said fifth layer of strengthening sheet material are comprised of one or more layers of same or different materials wherein said materials are: metal foil; plastic; synthetic foam; polymers; paper; or adhesive;

(m) wherein said third layer of frangible sheet material is comprised of one or more layers of same or different materials wherein said materials are: metal foil; plastic; polymers; or paper;

(n) wherein said closure seal includes one or more peripheral tabs providing means for retaining said closure seal in said closure cap;

(o) wherein said closure seal includes one or more additional layers of same or different sheet materials; wherein said sheet materials are: metal foil; plastic; polymers; synthetic foam; pulp board; paper; adhesive; or releasable adhesive; providing means for bonding said closure seal to said exterior rim;

(p) wherein said means for bonding said closure seal to said exterior rim comprise induction sealing, heat sealing, evaporative sealing, reactive sealing or ultrasonic sealing;

(q) wherein said first layer of strengthening sheet material and said fifth layer of strengthening sheet material are permanently laminated to said third layer of frangible sheet material by non adhesive means;

(r) wherein said non adhesive means comprising cladding or fusion bonding;

(s) wherein said pourable liquid includes either one of motor oil, transmission fluid, motor vehicle additives, lubricants, or chemicals;

(t) wherein said closure seal can be either; circular; oval; square; or rectangular in shape;

(u) wherein said flexible container can include integral bellows providing means to compress said flexible container.

* * * * *